US009512642B2

(12) United States Patent
Hollman

(10) Patent No.: US 9,512,642 B2
(45) Date of Patent: Dec. 6, 2016

(54) REPROGRAMMABLE CYLINDER LOCK

(71) Applicant: KEYLESS.CO, LLC, Irving, TX (US)

(72) Inventor: Joe Hollman, Irving, TX (US)

(73) Assignee: KEYLESS.CO, LLC, Irving, TX (US)

( * ) Notice: Subject to any disclaimer, the term of this patent is extended or adjusted under 35 U.S.C. 154(b) by 184 days.

(21) Appl. No.: 14/598,915

(22) Filed: Jan. 16, 2015

(65) Prior Publication Data

US 2015/0252590 A1 Sep. 10, 2015

(30) Foreign Application Priority Data

Mar. 7, 2014 (TH) ..... 1401001217

(51) Int. Cl.
*E05B 29/04* (2006.01)
*E05B 27/00* (2006.01)
*E05B 29/00* (2006.01)

(52) U.S. Cl.
CPC ..... *E05B 27/005* (2013.01); *E05B 29/004* (2013.01); *E05B 29/0046* (2013.01); *Y10T 70/7452* (2015.04); *Y10T 70/752* (2015.04); *Y10T 70/7599* (2015.04); *Y10T 70/7729* (2015.04)

(58) Field of Classification Search
CPC .. E05B 27/005; E05B 29/004; E05B 29/0026; E05B 29/0046; E05B 29/006; E05B 27/0046; E05B 27/0053; Y10T 70/752; Y10T 70/7446; Y10T 70/7452; Y10T 70/7469; Y10T 70/748; Y10T 70/7599; Y10T 70/7734; Y10T 70/7729
USPC ..... 70/386, 381–385, 337–343, 492–495,70/358, 368, 372, DIG. 44, DIG. 71
See application file for complete search history.

(56) References Cited

U.S. PATENT DOCUMENTS

| | | | | |
|---|---|---|---|---|
| 818,719 | A * | 4/1906 | Webb | E05B 29/00 70/377 |
| 2,247,621 | A * | 7/1941 | Speer | E05B 27/00 70/380 |
| 5,428,978 | A * | 7/1995 | Tsukano | E05B 17/04 70/276 |
| 5,431,034 | A * | 7/1995 | Fann | E05B 9/086 70/337 |
| 7,591,158 | B2 * | 9/2009 | Konno | B60R 25/02 70/184 |
| 8,336,348 | B2 * | 12/2012 | Dalton, Jr. | E05B 9/086 70/337 |
| 2010/0206025 | A1 * | 8/2010 | Boesel | E05B 29/00 70/340 |

* cited by examiner

*Primary Examiner* — Lloyd Gall
(74) *Attorney, Agent, or Firm* — JCIP; Joseph G. Chu

(57) ABSTRACT

A reprogrammable cylinder lock provides a lock system that allows a set of multiple keys with various lengths and cuts to work with a single cylinder lock to create multiple lock combinations. The reprogrammable lock comprises a cylinder core, a plurality of pin locks and a cylinder ring placed over the cylinder core in a first set position within a cylinder housing. The plurality of pin locks is configured such that it is initially nonrotatable. At least two different keys are provided. Upon inserting and rotating a first key into the cylinder core, the first key engages with a first lock combination so that the cylinder core is rotatable within the cylinder housing. Upon inserting and rotating subsequent keys into the cylinder core, the subsequent keys push the cylinder ring to subsequent set positions, create new lock combinations, and rotate the cylinder core within the cylinder housing.

20 Claims, 25 Drawing Sheets

REPROGRAMMABLE CYLINDER LOCK

RELATED APPLICATIONS

This application relates to, claims priority from, and incorporates herein by reference, as if fully set forth, the Thailand patent application No. 1401001217 filed on Mar. 7, 2014 entitled "Reprogrammable Cylinder" in Thai language.

BACKGROUND OF THE INVENTION

Field of the Invention

This invention generally relates to a device and a method of providing a reprogrammable lock which allows at least two different keys to be used with a single lock system.

BRIEF SUMMARY OF THE INVENTION

A current reprogrammable lock that embodies the invention described herein provides a lock system that allows a set of multiple keys to work with a single cylinder lock to create multiple lock combinations. In the event that a user loses one of the keys, the user can use any one of the remaining keys provided in the set to create a new lock combination to operate the lock, yet render the lost key inoperable to operate the same lock. This eliminates the need to replace an entire lock system from a door when a key is lost, yet maintains the maximum security of the lock in the event that an unauthorized person finds the lost key and attempts to use the lost key on the lock.

In one aspect, a reprogrammable lock comprises a cylinder core, a plurality of pin locks that are movable in and out of the cylinder core, a cylinder ring placed over and around the cylinder core in a first set position, wherein the cylinder ring is axially movable along the cylinder core, and a cylinder housing. The cylinder housing encloses the cylinder core, the plurality of pin locks, and the cylinder ring. In its default position, the plurality of pin locks is biased outward and flush against an internal contour of the cylinder housing such that the cylinder core is initially nonrotatable.

At least two keys with different cut configurations and different blade lengths are provided. Upon inserting a first key into the cylinder core through a keyway and rotating the first key, the first key engages with a lock combination within the cylinder core, the plurality of pin locks retracts inward into the cylinder core and the cylinder core is rotatable within the cylinder housing. When the first key is lost, the user can use a second key. As the second key has a different blade length and a different cut configuration from the first key, upon inserting the second key into the cylinder core and rotating the second key, the second key engages with the lock combination, pushes the cylinder ring in a direction away from the keyway to a second set position, and the plurality of pin locks retracts inward into the cylinder core to allow the cylinder core to rotate within the cylinder housing. When the second key is used, the lock combination is reprogrammed such that the first key can no longer be used to operate the lock.

In another aspect, a third key and a fourth key having yet different cut configurations and different blade lengths from the first key and the second key may be provided. In a similar manner, when the third key is used, the lock combination is reprogrammed such that the first key and the second key can no longer be used to operate the lock. When the fourth key is used, the lock combination is again reprogrammed such that the first key, the second key and the third key can no longer be used to operate the lock.

In yet another aspect, a method of providing a reprogrammable cylinder lock is provided. The method may comprise providing a cylinder core, providing a plurality of pin locks that is movable in and out of the cylinder core, and placing a cylinder ring over and around the cylinder core in a first set position, wherein the cylinder ring is axially movable along the cylinder core. The method further comprises enclosing the cylinder core, the plurality pin locks and the cylinder ring within a cylinder housing, wherein the plurality pin locks is biased outward and flush against an internal contour of the cylinder housing such that the cylinder core is initially nonrotatable. The method also comprises providing at least two keys with different cut configurations and different blade lengths, wherein upon inserting a first key into the cylinder core and rotating the first key, the plurality of pin locks retracts inward into the cylinder core to allow the cylinder core to rotate within the cylinder housing, and wherein upon removing the first key and inserting a second key into the cylinder core and rotating the second key, the second key axially pushes the cylinder ring in a direction away from the keyway to a second set position such that the plurality of pin locks retracts inward into the cylinder core to allow the cylinder core to rotate within the cylinder housing and reprogram the lock combination.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

Throughout the specification, positional and directional terms below refer to the following:

"Front" shall refer to the side or direction where a key slot or a "keyway" is located.

"Back" or "Rear" shall refer to the side or direction away from the keyway and toward a head bolt.

"Right" shall refer to the right side or direction when viewed from the back.

"Left" shall refer to the left side or direction when viewed from the back.

Figure 1:
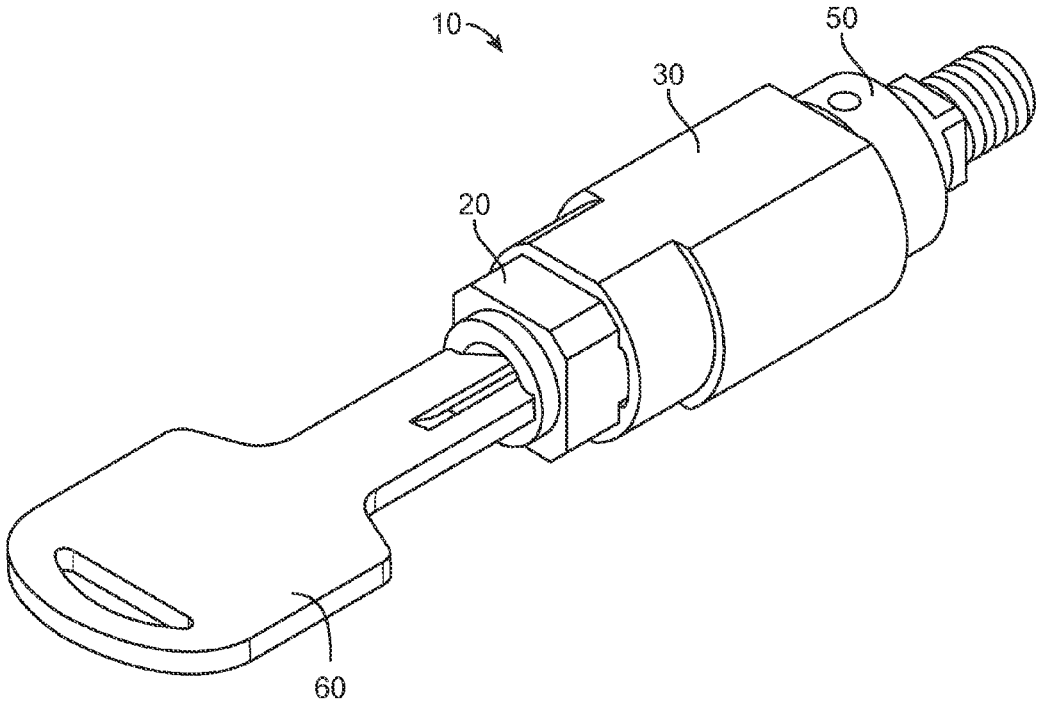
FIG. 1 is a front perspective view of a preferred embodiment of a fully assembled reprogrammable cylinder lock.

FIG. 1 illustrates a general overview of a preferred embodiment of a reprogrammable lock, or simply a lock, designated by a reference numeral 10. The lock 10 may be used on doors, cabinets, drawers, closets, safety boxes and the like. Here, an exterior view of the lock 10 in its fully assembled form is shown as comprising a cylinder core 20, a cylinder housing 30 and a head bolt 50. Further, FIG. 1 shows a first key 60 being inserted into the lock 10.

Figure 2:
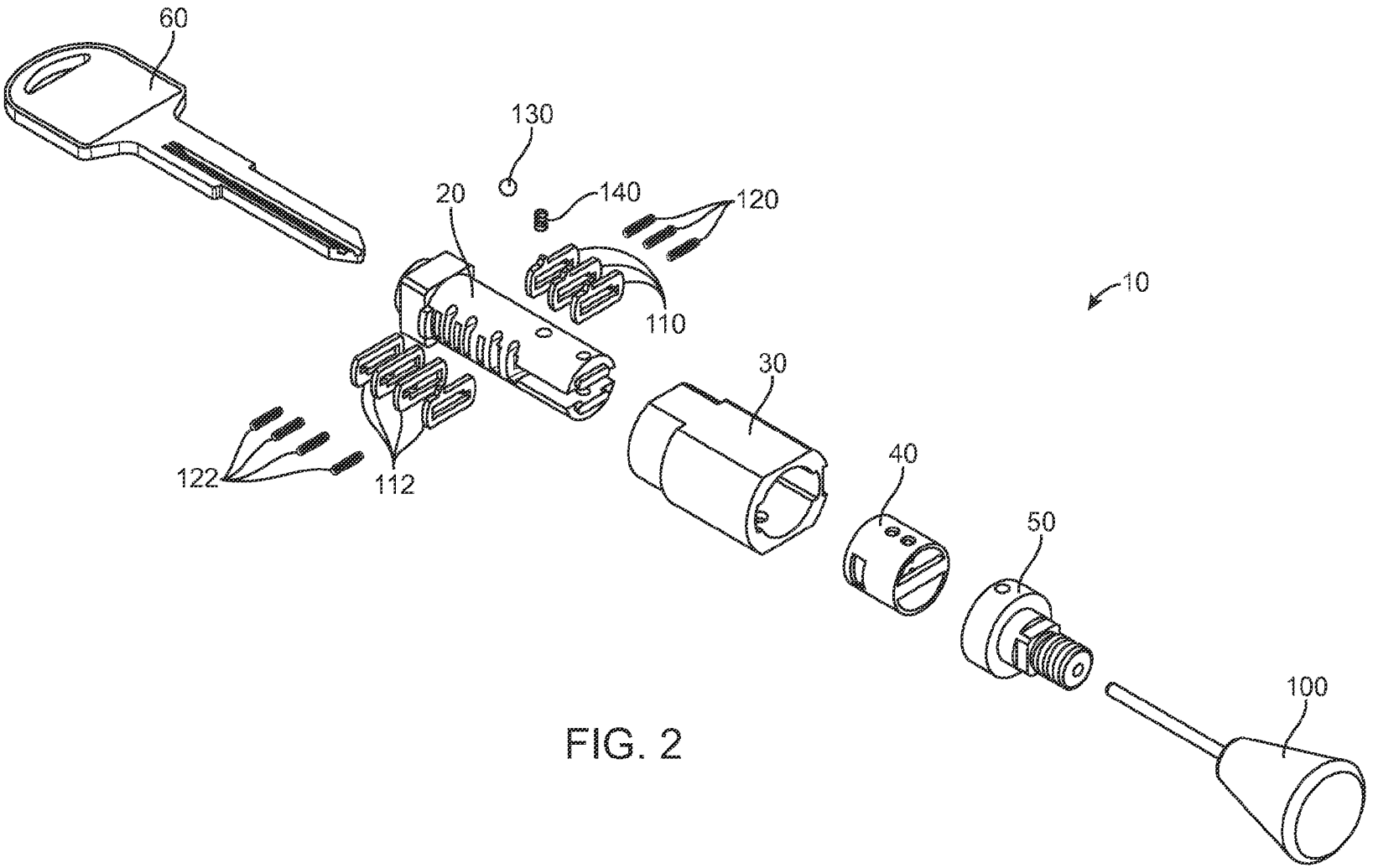
FIG. 2 is a top exploded view of the reprogrammable cylinder lock.
Figure 3:
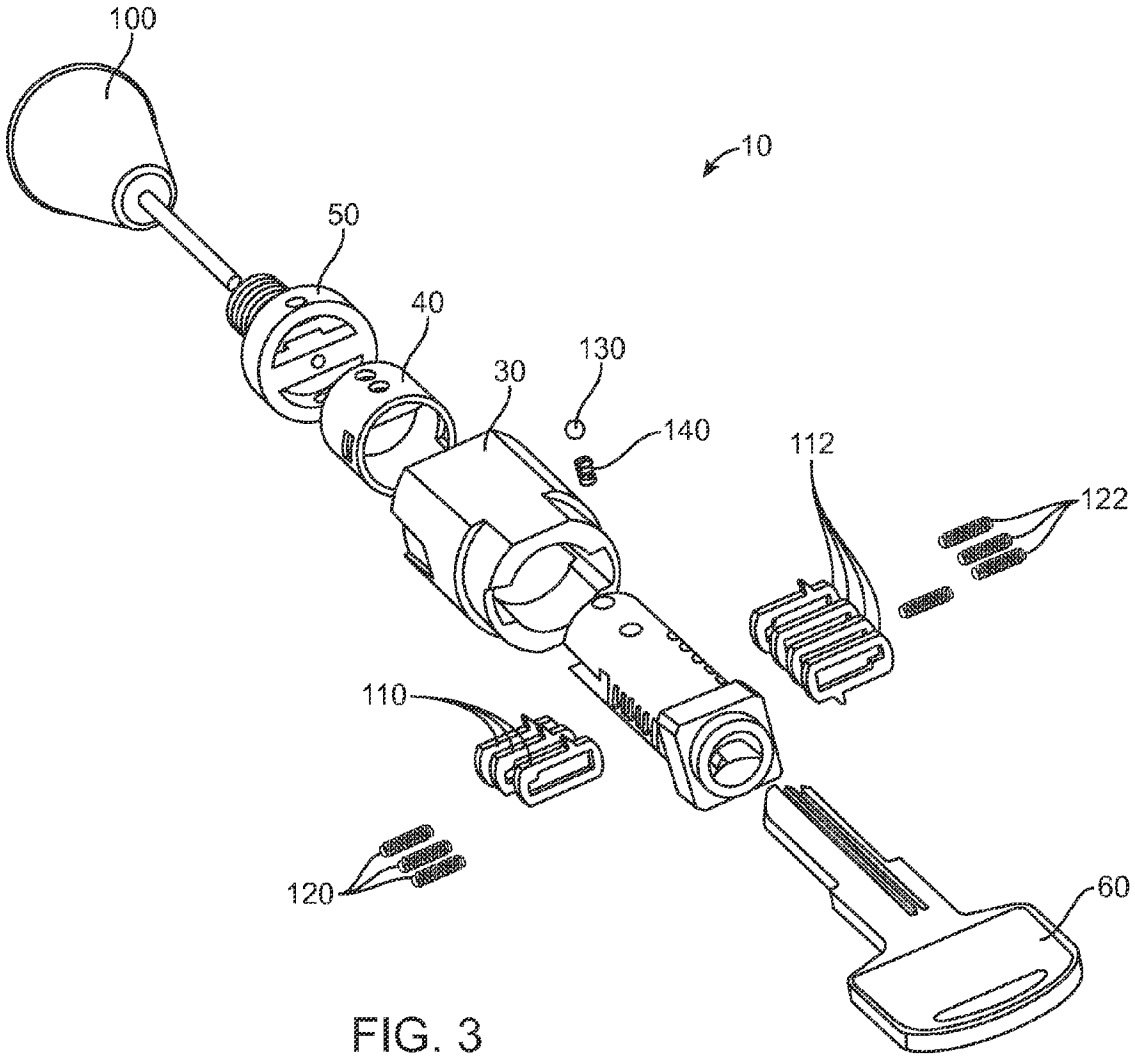
FIG. 3 is another top exploded view of the reprogrammable cylinder lock.

FIGS. 2-3 provide more detailed views of the various components of the lock 10. As shown here, the lock 10 generally comprises the cylinder core 20, a plurality of right pin locks 110, a plurality of right pin lock springs, or simply right springs, 120, a plurality of left pin locks 112, a plurality of left pin lock springs, or simply left springs, 122, the cylinder housing 30, a cylinder ring 40, and the head bolt 50. Preferably, a metal ball 130 and a metal ball spring 140 may also be provided. FIGS. 2-3 also show the first key 60 and a reset key 100.

Figure 4:
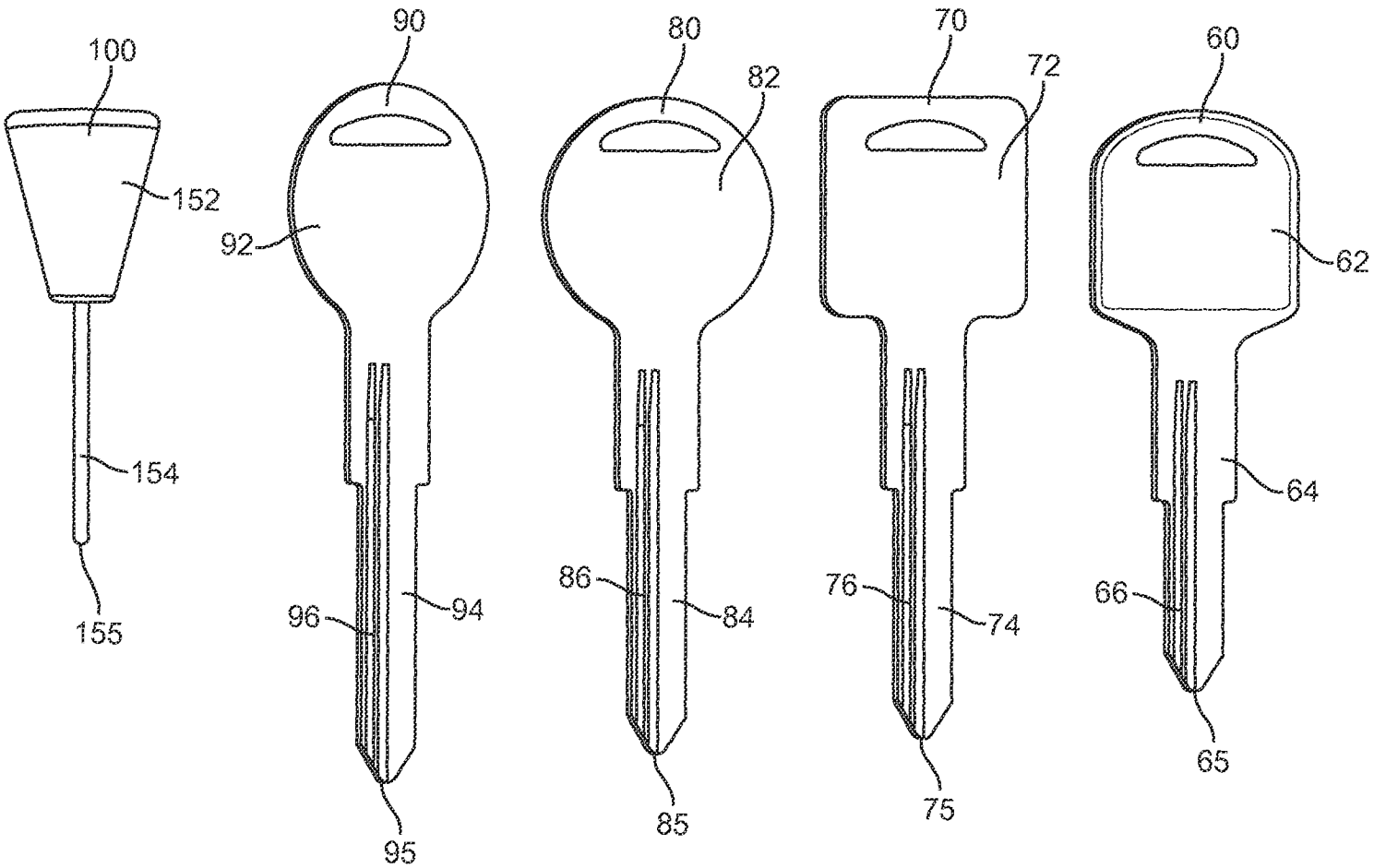
FIG. 4 is a front view of a set of multiple keys to be used with the reprogrammable cylinder lock.

As will be discussed in more details below, the lock 10 allows a set of multiple keys to be used with the cylinder core 20 to create multiple lock combinations. In one aspect of the invention, the cylinder core 20 can be used with at least two different keys. In another aspect, the cylinder core 20 can be used with three keys. In yet another aspect, the cylinder core 20 can be used with four keys. FIG. 4 illustrates an embodiment where four different keys may be used with the cylinder core 20, namely, the first key 60, a second key 70, a third key 80 and a fourth key 90. The first key 60 comprises a first bow 62, which is a protruding portion that allows a user to hold the first key 60 and apply torque to turn the first key 60, a first blade 64, which is an elongated portion of the first key 60 that is inserted into the cylinder core 20, a first set of cuts 66, which is a ridged portion of the first key 60, and a first tip 65. Similarly, the second key 70 comprises a second bow 72, a second blade 74, a second set of cuts 76, and a second tip 75; the third key 80 comprises a third bow 82, a third blade 84, a third set of cuts 86, and a third tip 85; and the fourth key 90 comprises a fourth bow 92, a fourth blade 94, a fourth set of cuts 96 and a fourth tip 95. As shown in FIG. 4, the first blade 64 is the shortest in length, the second blade 74 is longer than the first blade 64 and shorter than the third blade 84 and the fourth blade 94, the third blade 84 is longer than the first blade 64 and the second blade 74, yet shorter than the fourth blade 94, and the fourth blade 94 is the longest in length. According to an embodiment, the first set of cuts 66, the second set of cuts 76, the third set of cuts 86 and the fourth set of cuts 96 may have different grooves and configurations. Additionally, FIG. 4 also illustrates the reset key 100 comprising a reset key bow 152, a reset key pin blade 154, and a reset key tip 155.

Figure 5:
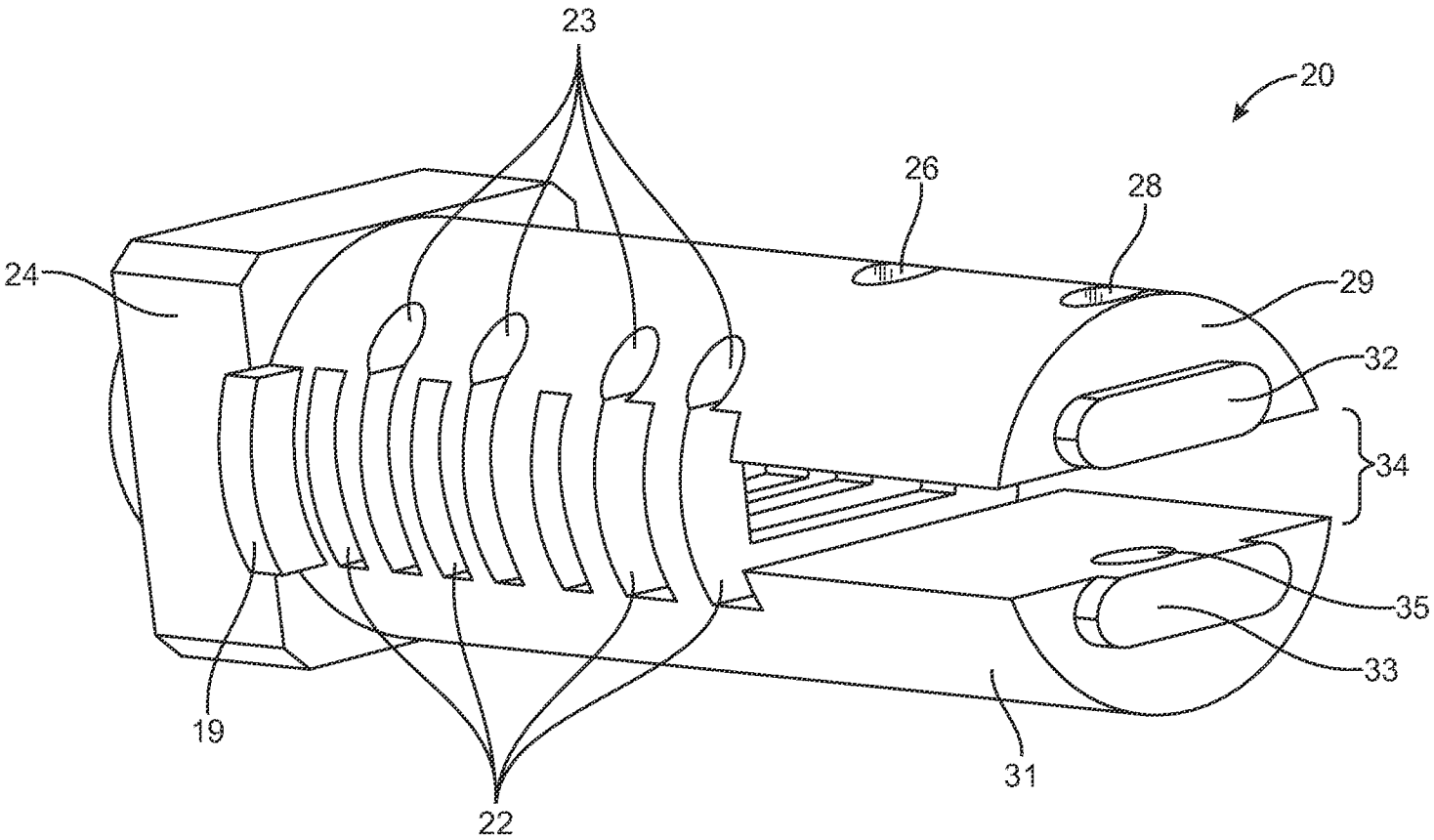
FIG. 5 is a rear perspective view of a cylinder core.
Figure 6:
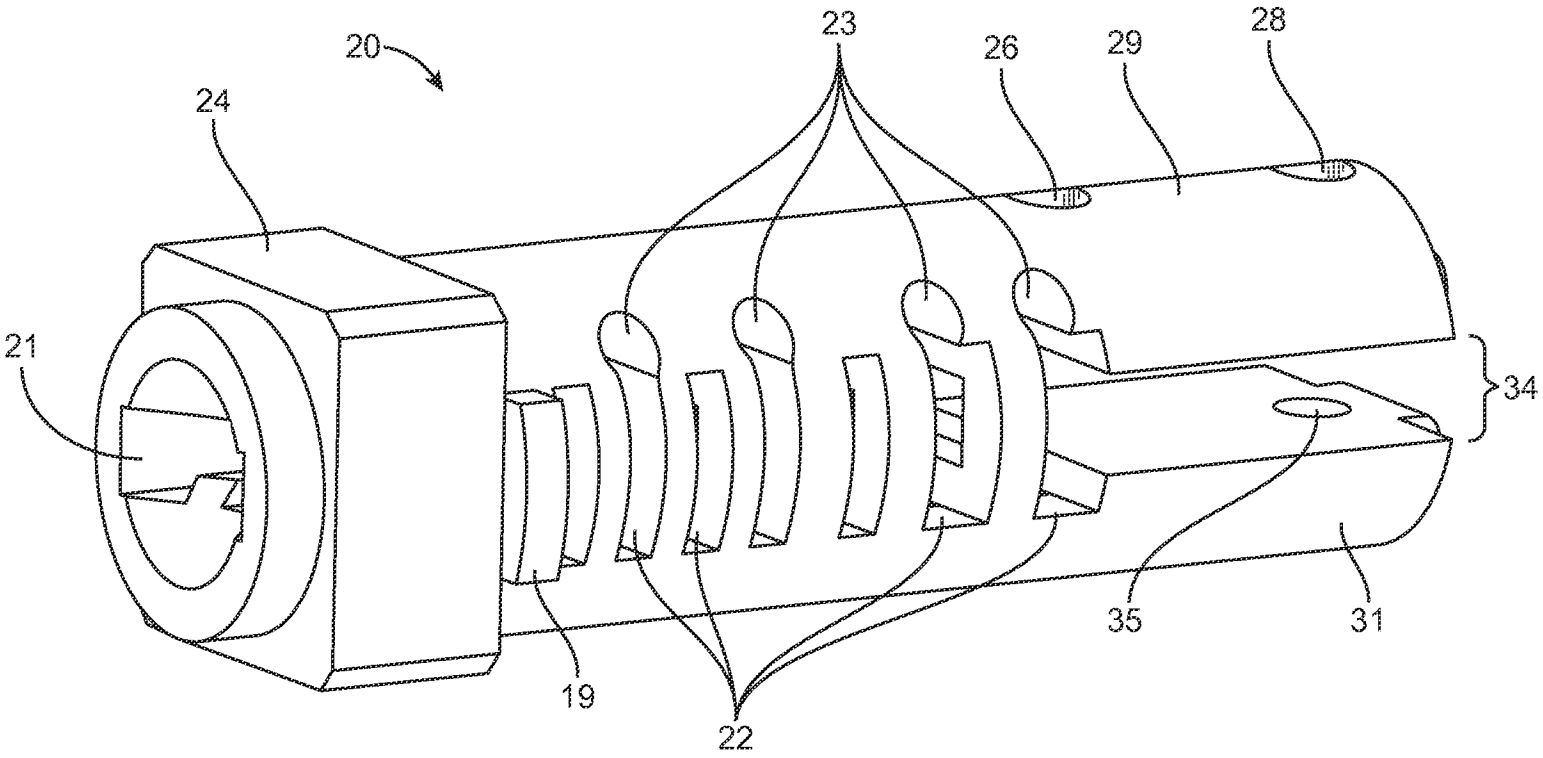
FIG. 6 is a left perspective view of the cylinder core.
Figure 7:
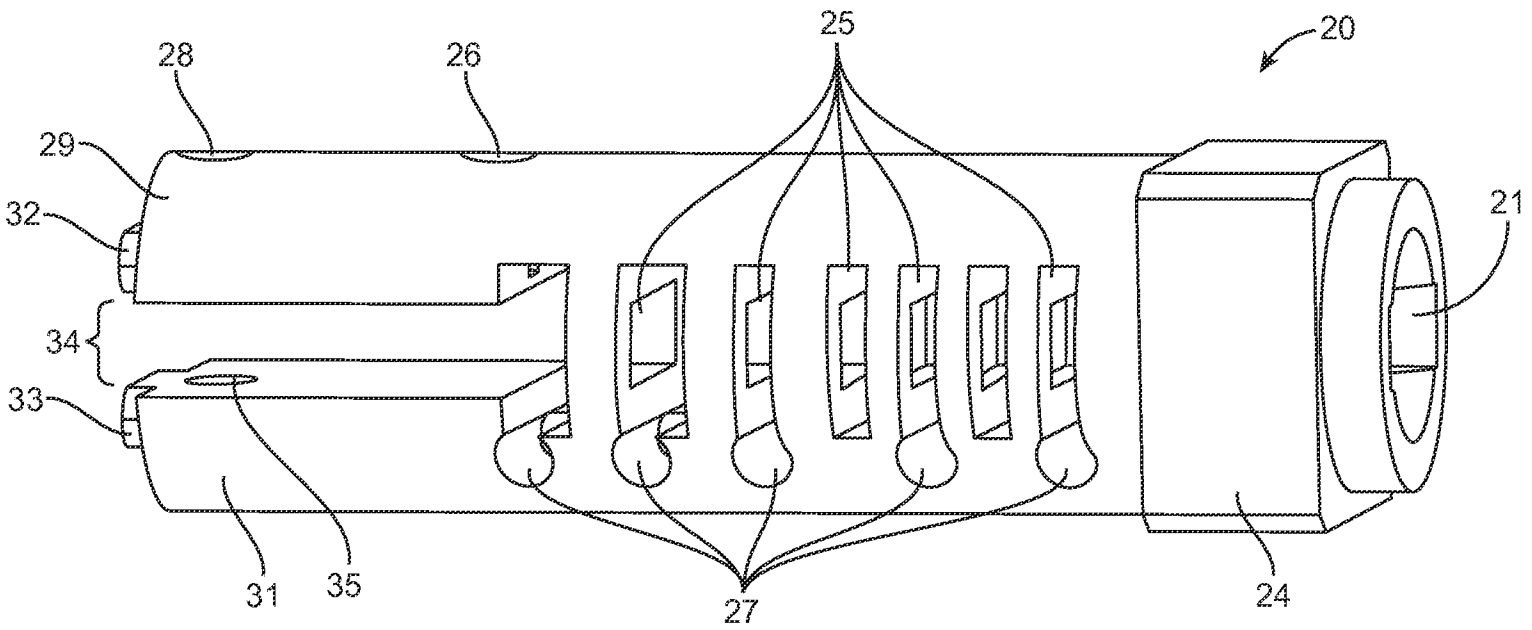
FIG. 7 is a right perspective view of the cylinder core.

FIGS. 5 through 7 show a preferred embodiment of the cylinder core 20. The cylinder core 20 generally comprises a keyway 21, a keyway base 24, a core stop 19, a plurality of left pin lock slots 22 in fluid connection with a plurality of left spring slots 23 and a plurality of right pin lock slots 25 in fluid connection with a plurality of right spring slots 27. The keyway base 24 rests against the front opening of the cylinder housing 30 to prevent the cylinder core 20 from sliding into cylinder housing 30. As shown in FIGS. 5 through 7, the plurality of left spring slots 23 is connected to the top portion of the plurality of left pin lock slots 22, and the plurality of left spring slots 23 does not have the corresponding openings on the opposite side of the cylinder core 20. On the other hand, the plurality of right spring slots 27 connected to the bottom portion of the plurality of right pin lock slots 25. Viewed from the left side, the plurality of right spring slots 27 does not have the corresponding openings on the other side of the cylinder core 20.

In one aspect, the cylinder core 20 is generally configured such that the plurality of left spring slots 23 are arranged in an alternating fashion with the plurality of right spring slots 27 on both sides of the cylinder core 20. For example, a first right spring slot 27-1 on the bottom right hand side of the cylinder core 20 is followed by a first left spring slot 23-1 on the top left hand side of the cylinder core 20, which in turn is followed by a second right spring slot 27-2 on the bottom right hand side of the cylinder core 20, followed by a second left spring slot 23-2 on the top left hand side of the cylinder core 20, followed by a third right spring slot 27-3 on the bottom right hand side of the cylinder core 20, followed by a third left spring slot 23-3, followed by fourth right spring slot 27-4, and finally followed by a fourth left spring slot 23-4 on the top left hand side of the cylinder core 20.

As shown in FIGS. 5 and 7, the back portion of the cylinder core 20 may be split into a rear cylinder core top 29 and a rear cylinder core bottom 31, such that an elongated gap 34 is provided. Further, the rear cylinder core top 29 further comprises a core top screw hole 28 and an elongated top dowel connector 32, and the rear cylinder core bottom 31 further comprises a core bottom screw hole 35 and an elongated bottom dowel connector 33. Further, a first metal ball chamber 26 may also be provided to place the metal ball 130 and the metal ball spring 140.

Figure 8:
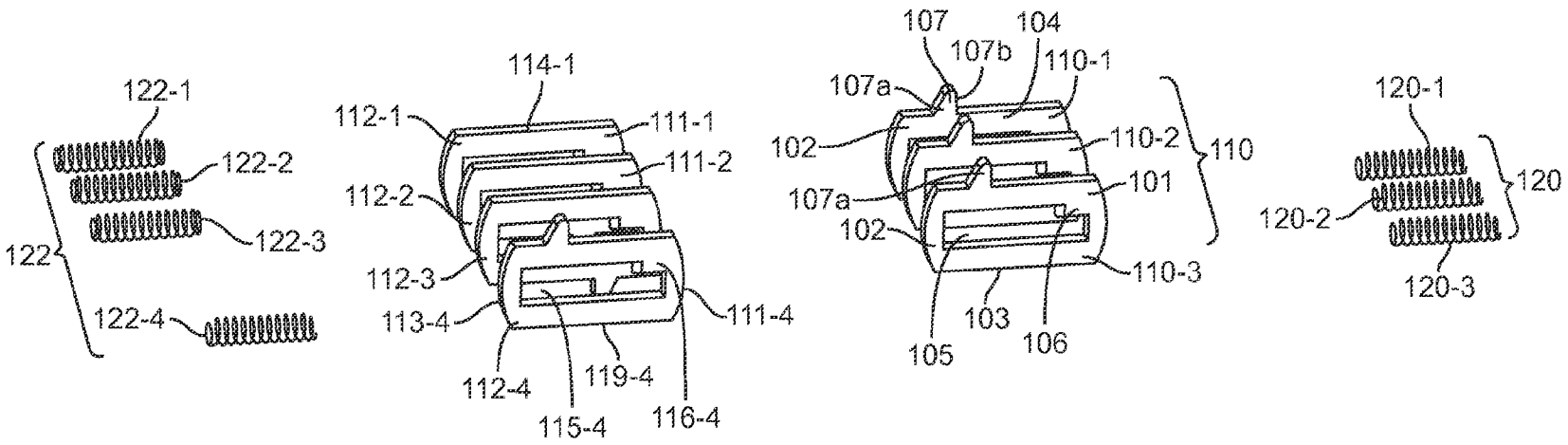
FIG. 8 is a rear exploded view of a plurality of pin locks and a plurality of pin lock springs.
Figure 9:
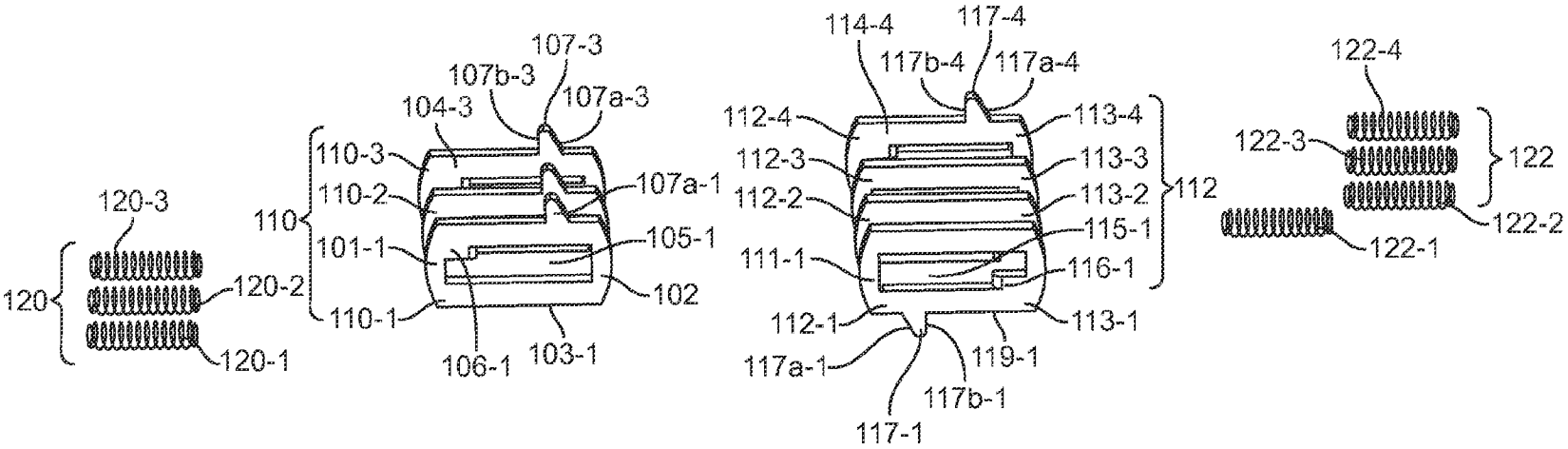
FIG. 9 is a front exploded view of the plurality of pin locks and the plurality of pin lock springs.

FIGS. 8 and 9 illustrate the plurality of right pin locks 110 and the plurality of left pin locks 112. As each of the plurality of right pin locks 110 is identical one from another, individual right pin locks 110 and their respective elements shall be denoted by the suffix "-1," "-2," "-3" and so forth. Similarly, as each of the plurality of left pin locks 112 is identical one from another, individual left pin locks 112 and their respective elements shall be denoted by the suffix "-1," "-2," "-3" and so forth.

Each of the right pin locks 110 generally comprises a curved right edge 101, a top edge 104, a curved left edge 102, a bottom edge 103, a center keyway opening 105, a ridge 106 and a spring tip 107. Further, the spring tip 107 may further comprise an angular side 107*a* and a vertical side 107*b*. In one aspect, the spring tips 107 may be pointing up.

Similarly, each of the left pin locks 112 generally comprises a curved left edge 111, a top edge 114, a curved left edge 113, a bottom edge 119, a center keyway opening 115, a ridge 116 and a spring tip 117. Further, the spring tip 117 may further comprise an angular side 117*a* and a vertical side 117*b*. In one aspect, some of the spring tips 117 may be pointing down, while at least one spring tip 117 may be pointing up.

The plurality of right pin locks 110 is placed inside the plurality of right pin lock slots 25 and the plurality of right springs 120 is placed inside the plurality of right spring slots 27. Similarly, the plurality of left pin locks 112 is placed inside the plurality of left pin lock slots 22 and the plurality of left springs 122 is placed inside the plurality of left spring slots 23.

As each of the plurality of right springs 120 is identical one from another, individual right springs 120 and their respective elements shall be denoted by the suffix "-1," "-2," "-3" and so forth. Similarly, as each of the plurality of left springs 122 is identical one from another, individual left springs 122 and their respective elements shall be denoted by the suffix "-1," "-2," "-3" and so forth.

Figure 10:
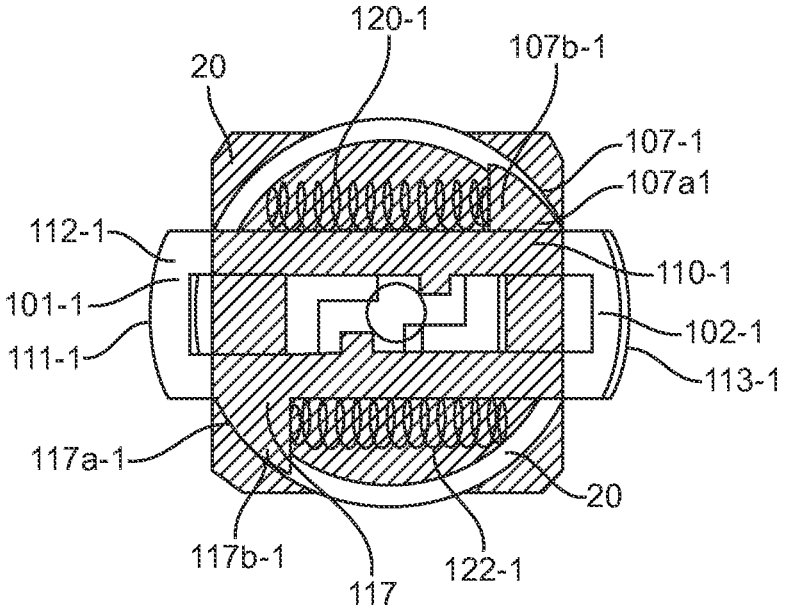
FIG. 10 is a cross-sectional view of the plurality of pin locks and the plurality of pin lock springs when fully assembled in the cylinder core.

As shown in FIG. 10, when the plurality of pin locks 110 and 112 and the plurality of springs 120 and 122 are placed in their respective slots 22, 23, 25 and 27, one end of each right spring 120 rests against the vertical side 107*b* of each spring tip 107, while the opposite end of each right spring 120 rests against the internal wall of the cylinder core 20. Likewise, one end of each left spring 122 rests against the vertical side 117*b* of each spring tip 117, while the opposite end of each left spring 122 rests against the internal wall of the cylinder core 20. In this configuration, when the key 60 is not inserted and/or turned, in the default position, the plurality of right springs 120 and the plurality of left springs 122 are in a decompressed state inside their respective spring slots and the plurality of right pin locks 110 and the plurality of left pin locks 112 protrude outward of their respective pin lock slots.

Figure 11:
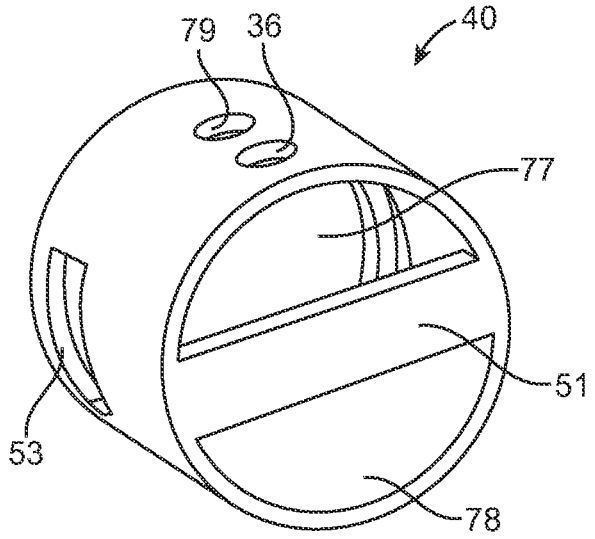
FIG. 11 is a rear perspective view of a cylinder ring.
Figure 12:
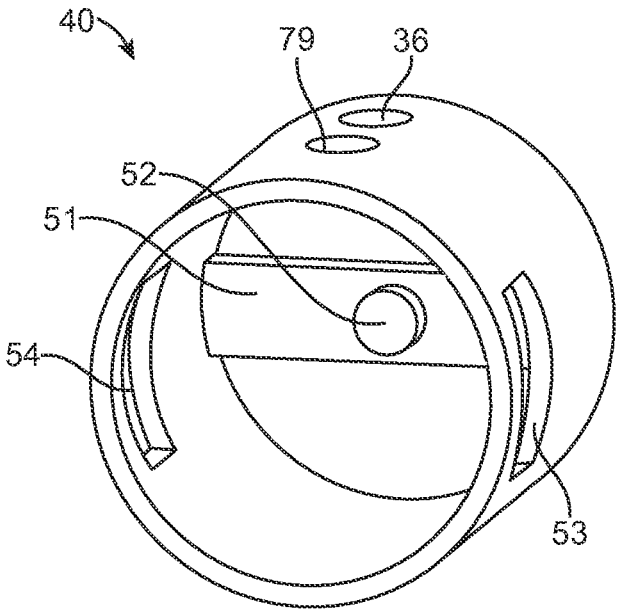
FIG. 12 is a front perspective view of the cylinder ring.
Figure 13:
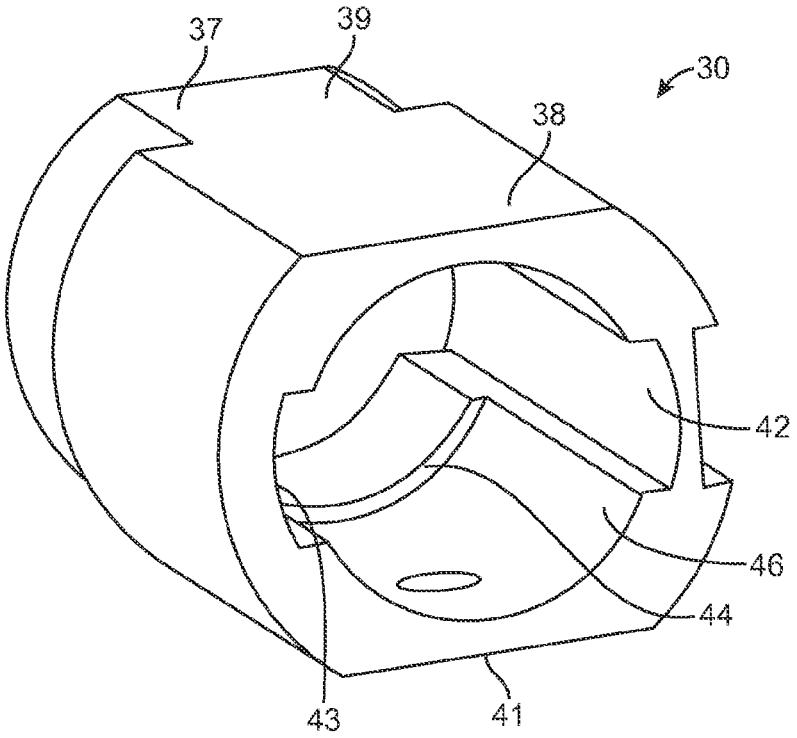
FIG. 13 is a rear perspective view of a cylinder housing.

FIGS. 11 and 12 demonstrate an embodiment of the cylinder ring 40. As shown, the cylinder ring 40 comprises a first metal ball notch 79, a second metal ball notch 36, a cylinder ring bar 51, a center notch 52, a left pin lock slit 53, a right pin lock slit 54, a cylinder ring top opening 77 and a cylinder ring bottom opening 78. In another aspect, the cylinder ring 40 may comprise additional metal ball notches. As shown, the cylinder ring 40 has a larger diameter than the cylinder core 20, yet a smaller diameter than the cylinder housing 30.

FIGS. 13 through 16 illustrate the cylinder housing 30 according to an embodiment. The cylinder housing 30 may comprise a front portion 37 and a back portion 38 that share a common flat top 39 and a common flat bottom 41. Further, this particular embodiment shows that the front portion 37 generally has smaller external and internal diameters than the back portion 38. The difference in the internal diameters creates a circumferential step ledge 44 that separates a front inner chamber 45 of the front portion 37 and a back inner chamber 46 of the back portion 38. The larger diameter of the back inner chamber 46 accommodates enclosure of the cylinder ring 40, which is placed over, and is axially movable along, the cylinder core 20.

Figure 15:
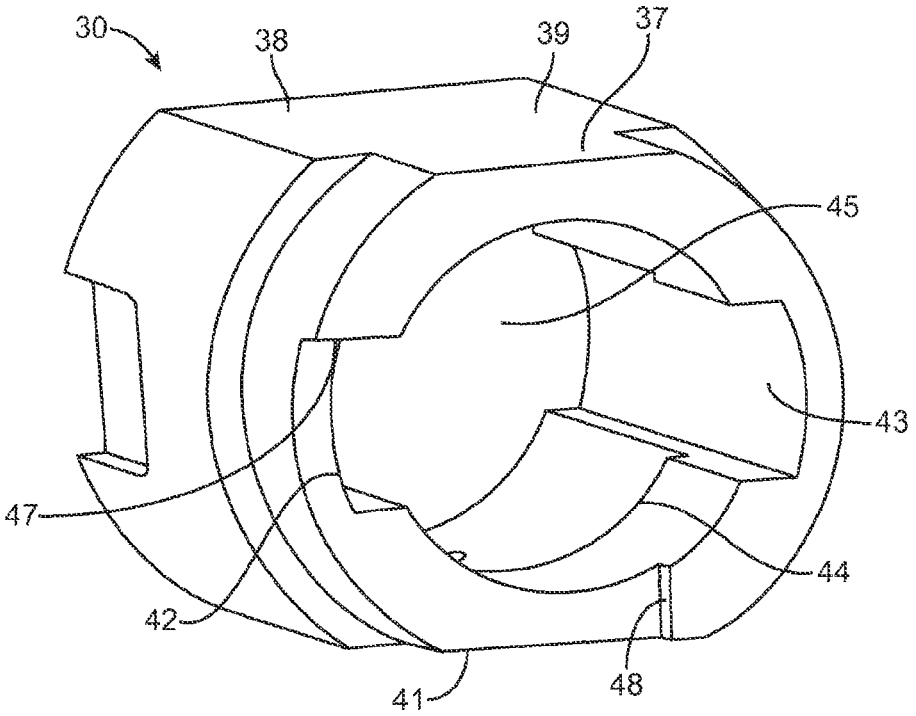
FIG. 15 is a front perspective view of the cylinder housing.
Figure 16:
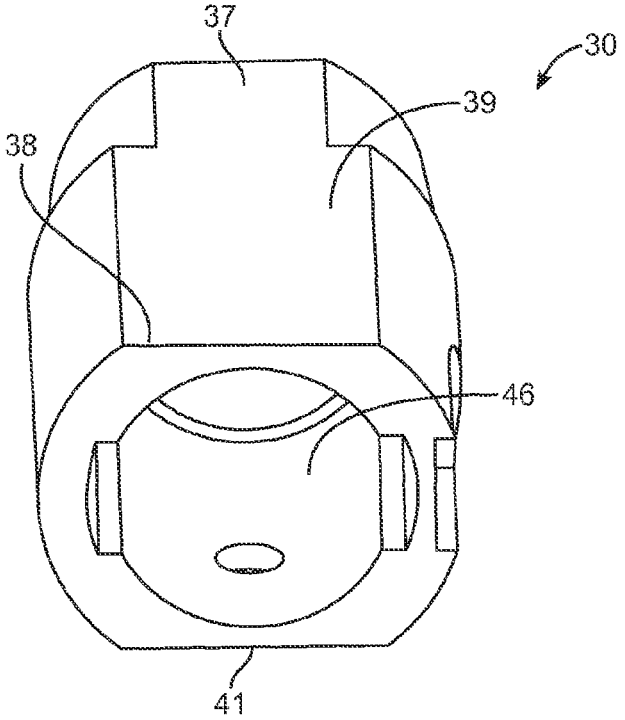
FIG. 16 is a top perspective view of the cylinder housing.

FIG. 15 shows a front upper stop ledge 47 and a front lower stop ledge 48. When the lock 10 is fully assembled, as shown in FIG. 1, the cylinder housing 30 encloses both the cylinder core 20 and the cylinder core ring 40. As will be discussed in further details below, when the right key is used to engage the correct combination of the plurality of right pin locks 110 and the plurality of left pin locks 112, the cylinder core 20 is rotatable either in a clockwise direction or a counterclockwise direction. To prevent the cylinder core 20 from rotating too far in either direction, e.g. beyond 90°, the core stop 19 is halted by either the upper stop ledge 47 or the lower stop ledge 48.

Figure 14:
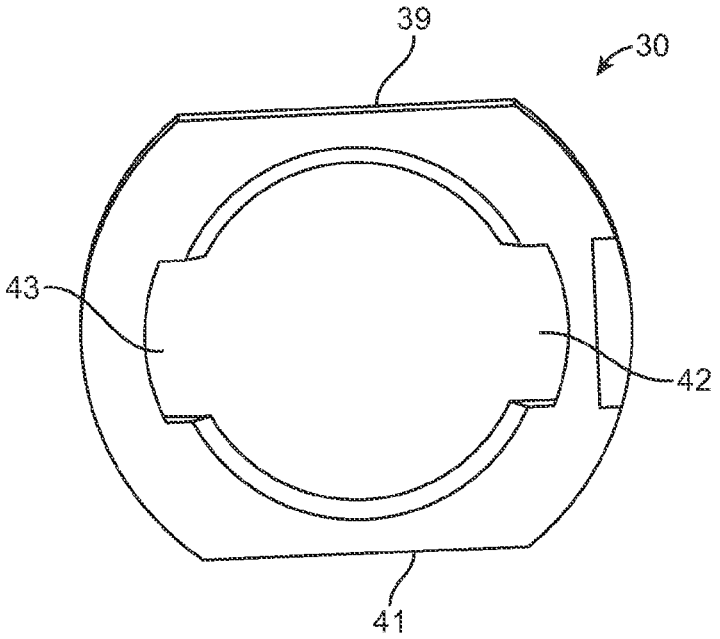
FIG. 14 is a front view of the cylinder housing.

As shown in the figures, the front inner chamber 45 and the back the inner chamber 46 share a continuous elongated right internal groove 42 and an identical continuous elongated left internal groove 43 from front to back. FIG. 14 illustrates that the internal curvature or contour of both the right internal groove 42 and the left internal groove 43 match the curvature of the curved right edge 101 and the curve right edge 102 of the plurality of right pin locks 110, as well as the curved right edge 113 and the curved left edge 111 of the plurality of left pin locks 112. When the lock 10 is fully assembled and in the default position (i.e., without the key 60 inserted and/or rotated), this internal configuration allows the plurality of right pin locks 110 and the plurality of left pin locks 112 to be biased outward and flush against the curvature of the right internal groove 42 and the left internal groove 43, such that the cylinder core 20 is initially nonrotatable inside the housing 30.

Figure 17:
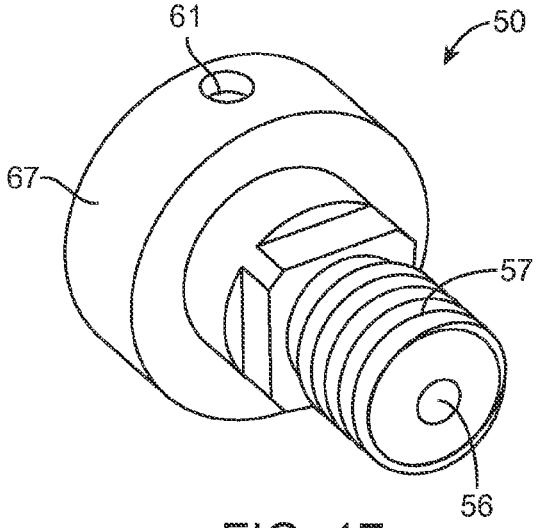
FIG. 17 is a rear perspective view of a head bolt.
Figure 18:
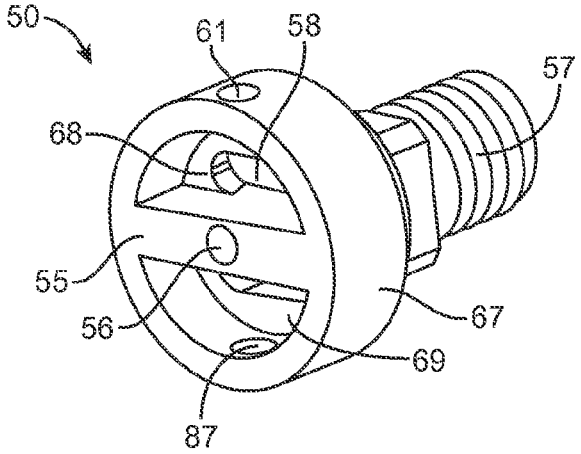
FIG. 18 is a front perspective view of the head bolt.
Figure 19:
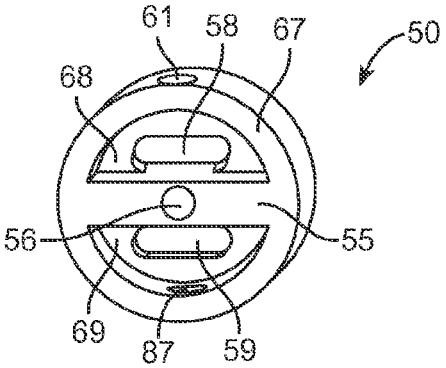
FIG. 19 is a front view of the head bolt.

FIGS. 17 through 19 illustrate an embodiment of the head bolt 50. As shown, the head bolt 50 comprises a head bolt bar 55, a reset key channel 56, a head bolt thread 57, a top dowel connector recess 58, a bottom dowel connector recess 59, a head bolt outer rim 67, a top core recess 68, a bottom core recess 69, a top screw hole 61 and a bottom screw hole 87. The top core recess 68 has a shape that matches the shape of the rear cylinder core top 29 and the bottom core recess 69 has a shape that matches the shape of the rear cylinder core bottom 31. As shown, the head bolt outer rim 67 has a larger diameter than the cylinder ring 40. When the lock 10 is fully assembled, the rear cylinder core top 29 fits into the top core recess 68, the top dowel connector 32 fits into the top dowel connector recess 58, the rear cylinder core bottom 31 fits into the bottom core recess 69, the bottom dowel connector 33 fits into the bottom dowel connector recess 59, and the head bolt bar 55 aligns with the cylinder ring bar 51. Further, when in use with a door, a drawer or a cabinet, the head bolt thread 57 is attached to a door latch or a door handle to allow the cylinder core 20 to be rotated.

Figure 20:
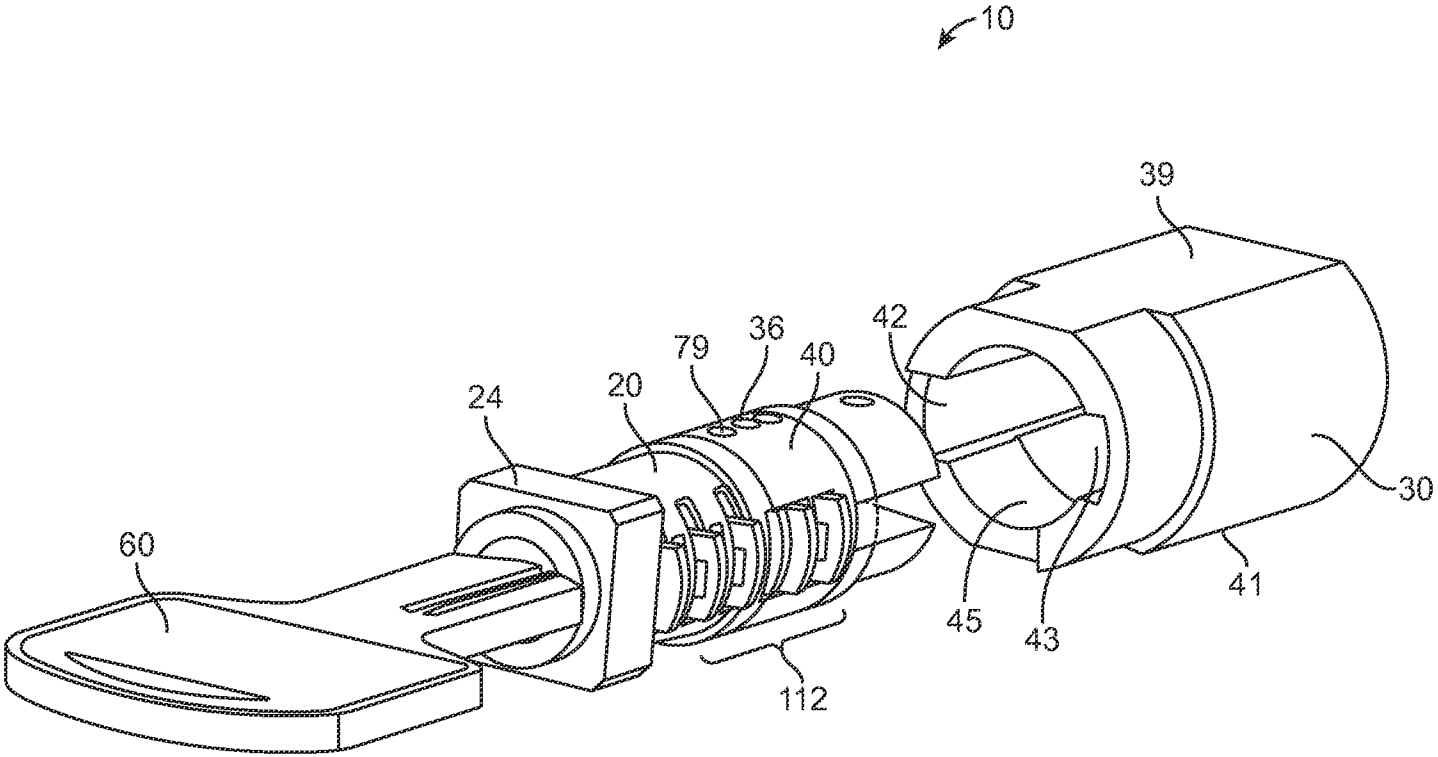
FIG. 20 is a front perspective view of the fully assembled cylinder core and the cylinder ring with a first key inserted prior to being enclosed in the cylinder housing.
Figure 21:
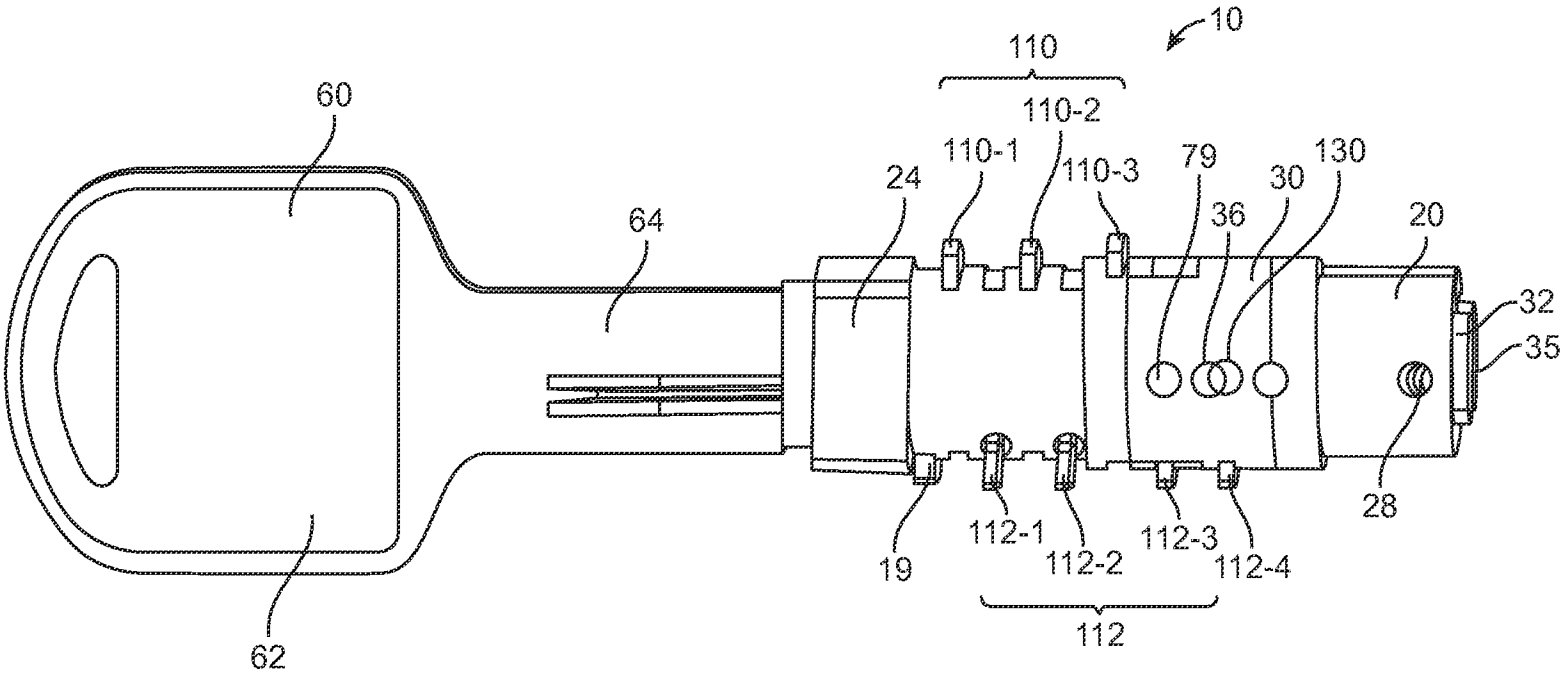
FIG. 21 is a top view of the fully assembled cylinder core and the cylinder ring inside the cylinder housing with the first key inserted.
Figure 22:
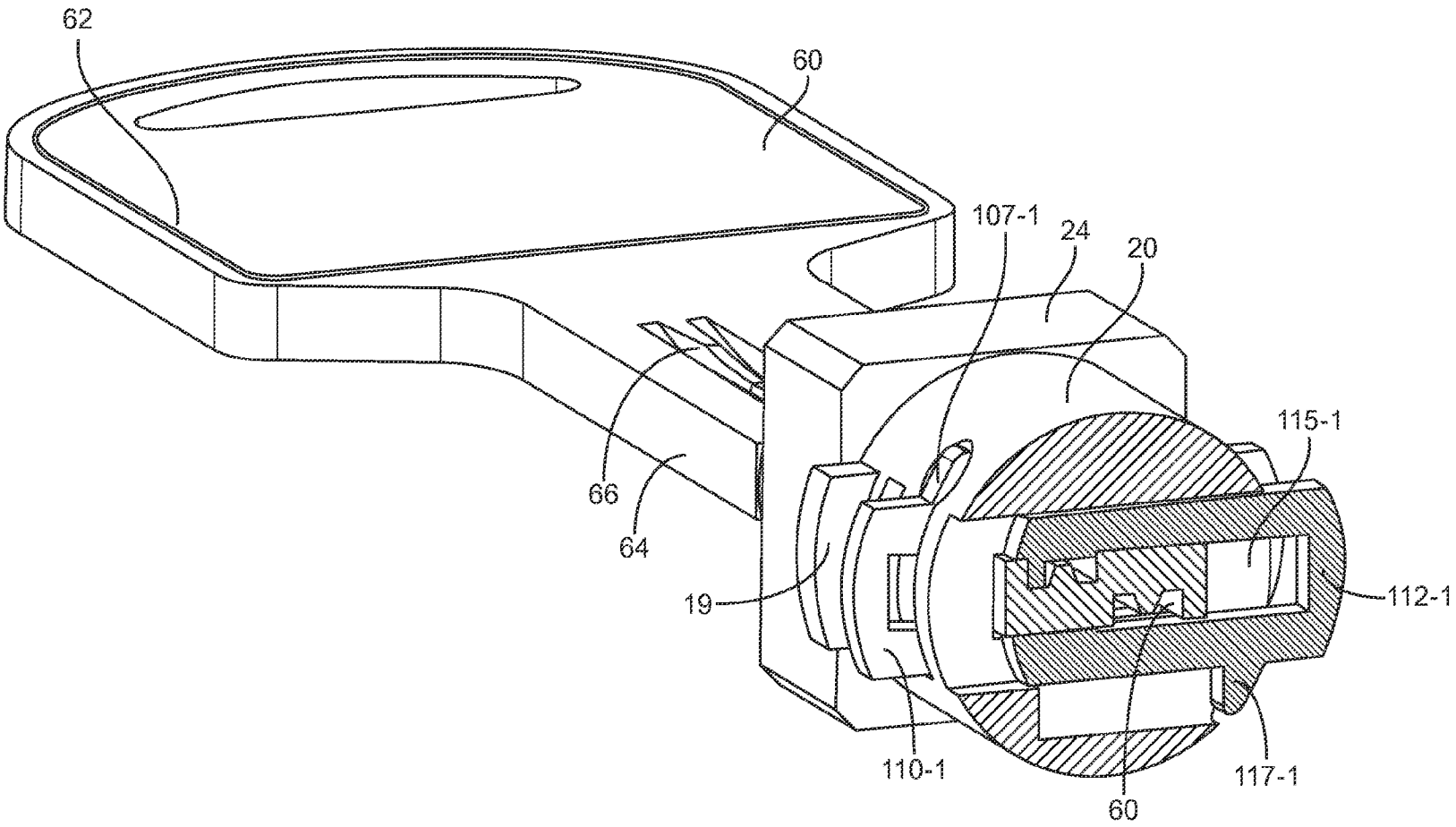
FIG. 22 is a rear cross-sectional view of the fully assembled cylinder core and the cylinder ring with the first key inserted.
Figure 23:
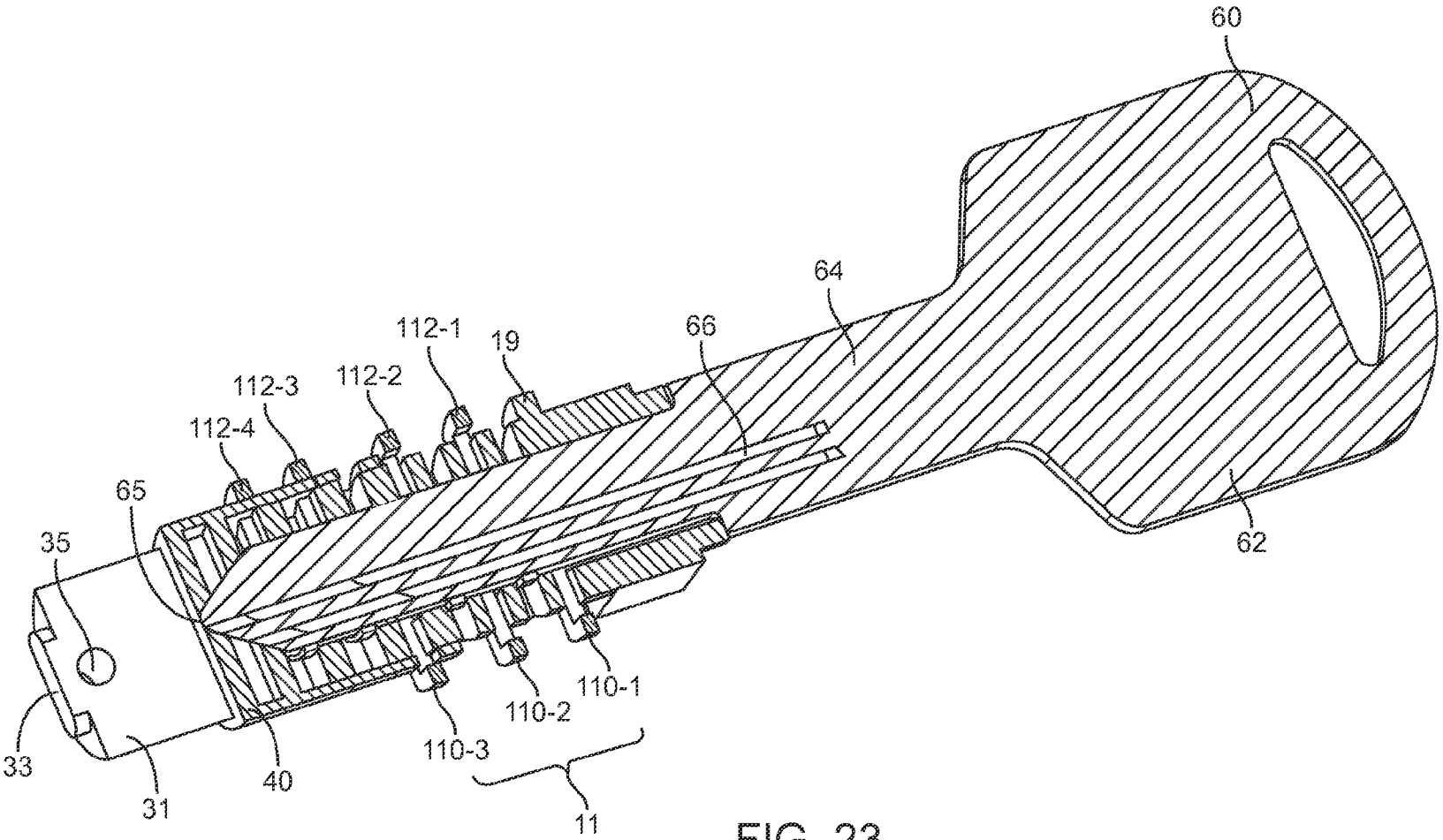
FIG. 23 is a perspective cross-sectional view of the first key inside the cylinder core and the cylinder ring.
Figure 24:
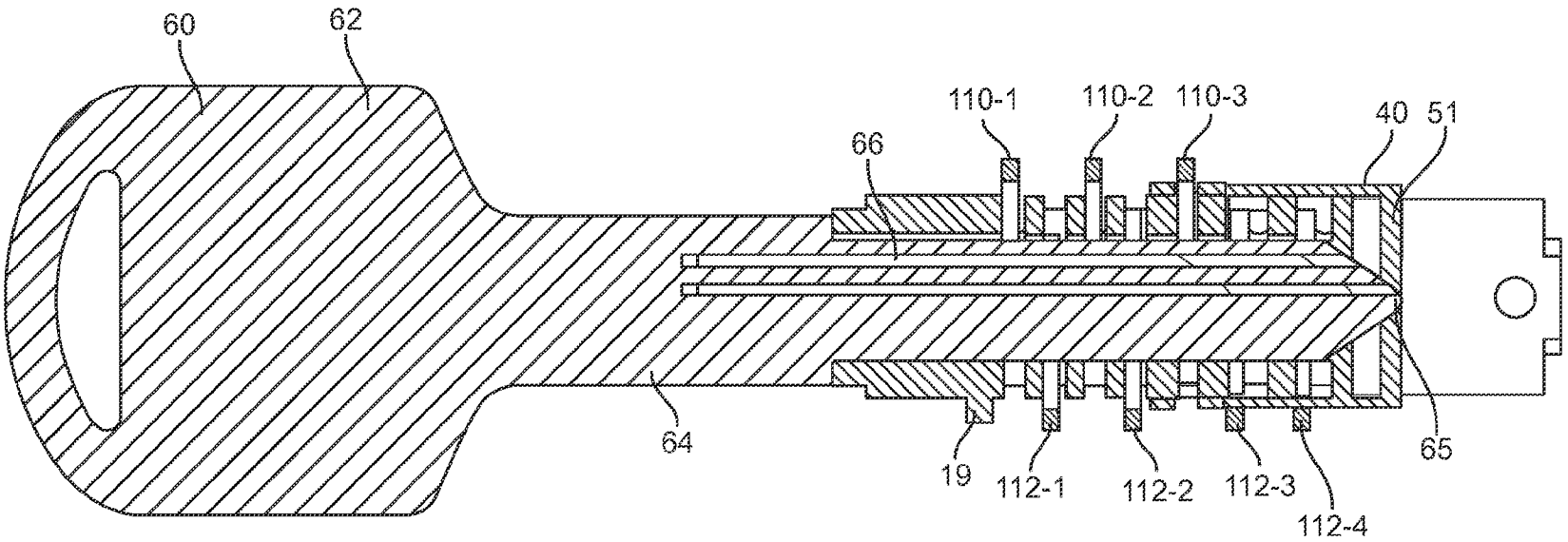
FIG. 24 is a top cross-sectional view of the first key inside the cylinder core and the cylinder ring.

FIGS. 20-25 illustrate the internal and external workings of the fully assembled lock 10 with the first key 60 inserted. When the lock 10 is fully assembled, the plurality of right pin locks 110 is placed and movable inside the plurality of right pin lock slots 25, and the plurality of left pin locks 112 is placed and movable inside the plurality of left pin lock slots 22. As described above, the plurality of right springs 120 is placed inside the plurality of right spring slots 27, wherein one end of each right spring 120 rests against the vertical side 107*b* of each spring tip 107, while the opposite end of each right spring 120 rests against the internal wall of the cylinder core 20. Similarly, the plurality of left springs 122 is placed inside the plurality of left spring slots 23, wherein one end of each left spring 122 rests against the vertical side 117*b* of each spring tip 117, while the opposite end of each left spring 122 rests against the internal wall of the cylinder core 20. Accordingly, because in the default position the plurality of right springs 120 and the plurality of left springs 122 are decompressed inside their respective spring slots, FIGS. 20-22 show the plurality of right pin locks 110 and the plurality of left pin locks 112 biased and protruding outward of their respective pin lock slots. According to the preferred embodiment, the metal ball 130 and the metal ball spring 140 are placed inside the metal ball chamber 26, wherein the metal ball spring 140 is placed under the metal ball 130.

The cylinder core 20 is inserted into the cylinder ring 40 such that that the rear cylinder core top 29 slides into the cylinder ring top opening 77, the rear cylinder core bottom 31 slides into the cylinder ring bottom opening 78, and the cylinder ring bar 51 slides into the gap 34. The rear cylinder core top 29 is further inserted into the top rear core slot 68 of the head bolt 50 such that the rear top dowel connector 32 fits into the top dowel connector slot 58, and the rear cylinder core bottom 31 is further inserted into the bottom core slot 69 of the head bolt 50 such that the rear bottom dowel connector 33 fits into the bottom dowel connector slot 59. The connection between the cylinder core 20 and the head bolt 50 is secured by inserting a bolt, a pin or a screw (not pictured) through the core top screw hole 28, the core bottom screw hole 35, the head bolt top screw hole 61 and the head bolt bottom screw hole 87.

In this configuration, it shall be appreciated that the cylinder ring 40 is axially movable along the cylinder core 20 by allowing the cylinder ring bar 51 to slide along the gap 34, and the head bolt outer rim 67 prevents the cylinder ring 40 from sliding out of the assembly.

Figure 25:
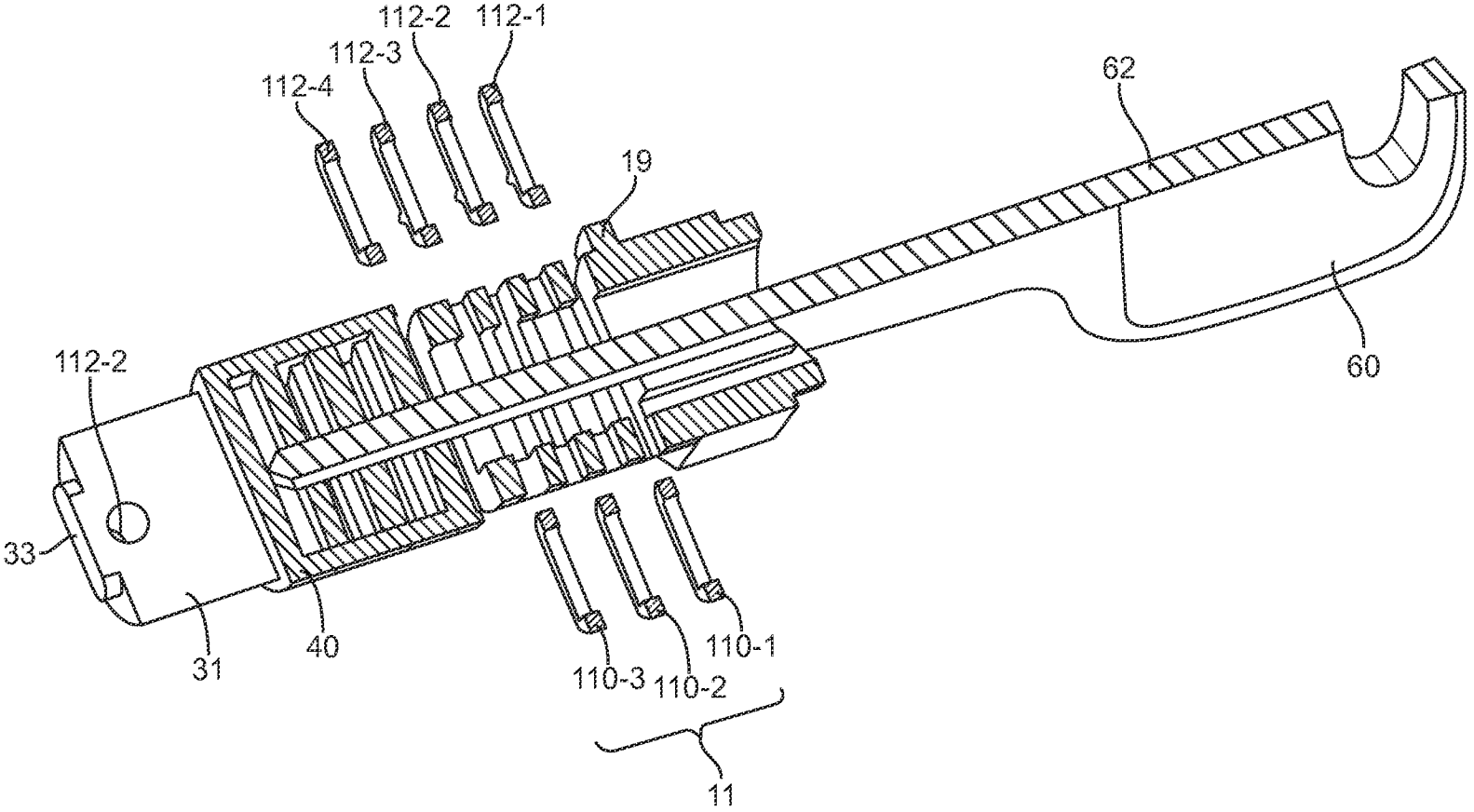
FIG. 25 is a perspective cross-sectional view of the first key inside the cylinder core and the cylinder ring as the key is turned.

As illustrated in FIG. 1, the cylinder housing 30 encloses the cylinder core 20 and the cylinder ring 40. As previously discussed, the internal curvature of both the right internal groove 42 and the left internal groove 43 match the curvature of the curved right edge 101 and the curve right edge 102 of the plurality of right pin locks 110, as well as the curved right edge 113 and the curved left edge 111 of the plurality of left pin locks 112. As shown in FIGS. 20-24, in the default position, this internal configuration allows the plurality of right pin locks 110 and the plurality of left pin locks 112 to be biased outward and flush against the curvature of the right internal groove 42 and the left internal groove 43, such that the cylinder core 20 is initially nonrotatable. FIG. 25 illustrates the key 60 being turned inside the cylinder core, preferably at a 90° angle. When the key 60 is turned, tension is applied to the plurality of right springs 120 and the plurality of left springs 122, causing the corresponding plurality of right pin locks 110 and the corresponding plurality of left pin locks 112 to retract into their respective pin lock slots 22 and 25.

Having described the various components of the embodiments of the lock 10 in greater details, the principles of operation of the reprogrammable lock 10 can be further understood by referring to the following description and FIGS. 26A through 29B.

Figure 26B:
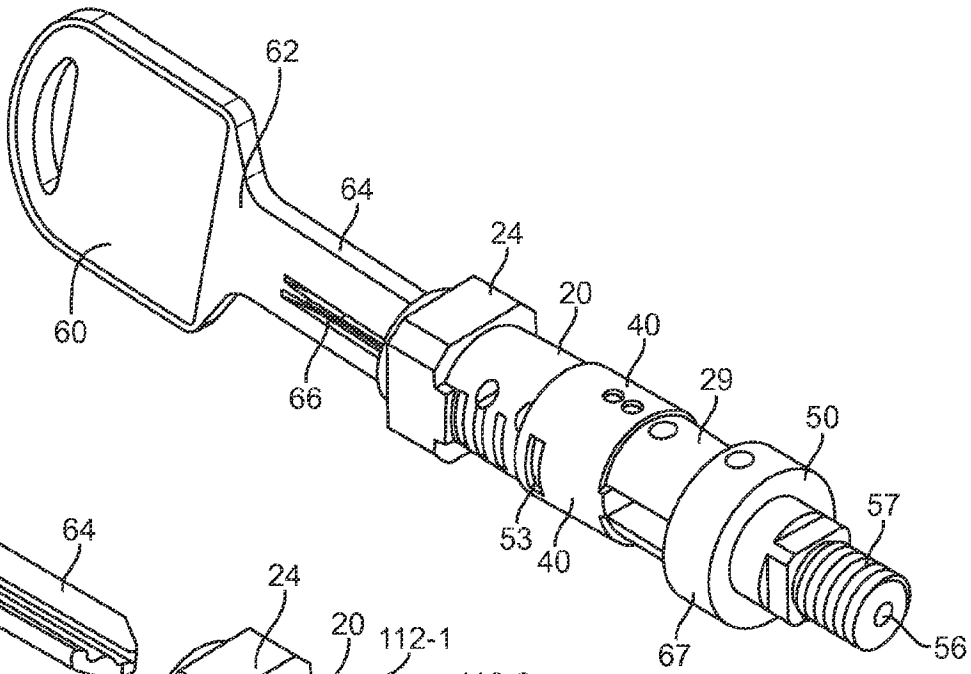
FIG. 26B is a perspective view of the reprogrammable cylinder lock as the first key is inserted to operate the reprogrammable lock.
Figure 26A:
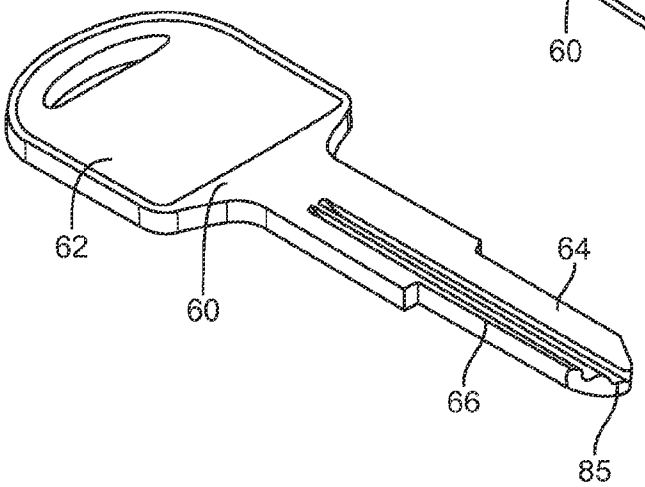
FIG. 26A is a perspective view of the reprogrammable cylinder lock prior to inserting the first key to operate the reprogrammable lock.

In one aspect, in a first code combination A shown FIGS. 26A-26B, the cylinder ring 40 is initially positioned in a first position toward the center of the cylinder core 20, wherein two right pin locks, a first right pin lock 110-1 and a second right pin lock 110-2, and two left pin locks, a first left pin lock 112-1 and a second left pin lock 112-2, are activated and biased against the right internal groove 42 and the left internal groove 43 of the cylinder housing 30. The internal wall of the cylinder ring 40 covers the remainder of the plurality of right pin locks 110 and the plurality of left pin locks 112, and pushes them into the respective plurality of right pin lock slots 25 and plurality of left pin lock slots 22. Further, the internal wall of the cylinder ring 40 also pushes the metal ball 130 and compresses the metal ball spring 140 into the metal ball chamber 26.

Referring to FIGS. 22-26B, as the first key 60 is inserted into the lock 10 through the keyway 21, the first blade 64 slides through a first right pin lock opening 105-1, a first left pin lock opening 115-1, a second right pin lock opening 105-2 and a second left pin lock opening 115-2. The first set of cuts 66 then engages with a first right pin lock ridge 106-1, a first left pin lock ridge 116-1, a second right pin lock ridge 106-2 and a second left pin lock ridge 116-2. Upon applying torque to the first bow 62 and rotating the cylinder core 20, preferably at 90°, the first left pin lock 112-1, the first right pin lock 110-1, the second left pin lock 112-2 and the second right pin lock 110-2 are forced to be displaced from the right internal groove 42 and the left internal groove 43. A first right spring 120-1 attached to the first right pin lock 110-1 and a second right spring 120-2 attached to the second right pin lock 110-2 are compressed into the first right spring slot 27-1 and the second right spring slot 27-2 respectively. Similarly, a first left spring 122-1 attached to the first left pin lock 112-1 and a second left spring 122-2 attached to the second left pin lock 112-2 are forced to be compressed into the first left spring slot 23-1 and the second left spring slot 23-2 respectively. As a result, the first right pin lock 110-1 retracts into a first right pin lock slot 25-1, the second right pin lock 110-2 retracts into a second right pin lock slot 25-2, the first left pin lock 112-1 retracts into a first left pin lock slot 22-1, the second left pin lock 112-2 retracts into a second left pin lock slot 22-2. In this configuration, the cylinder core 20 becomes rotatable within the cylinder housing 30 to unlock the door handle or latch using the first key 60.

Figure 27B:
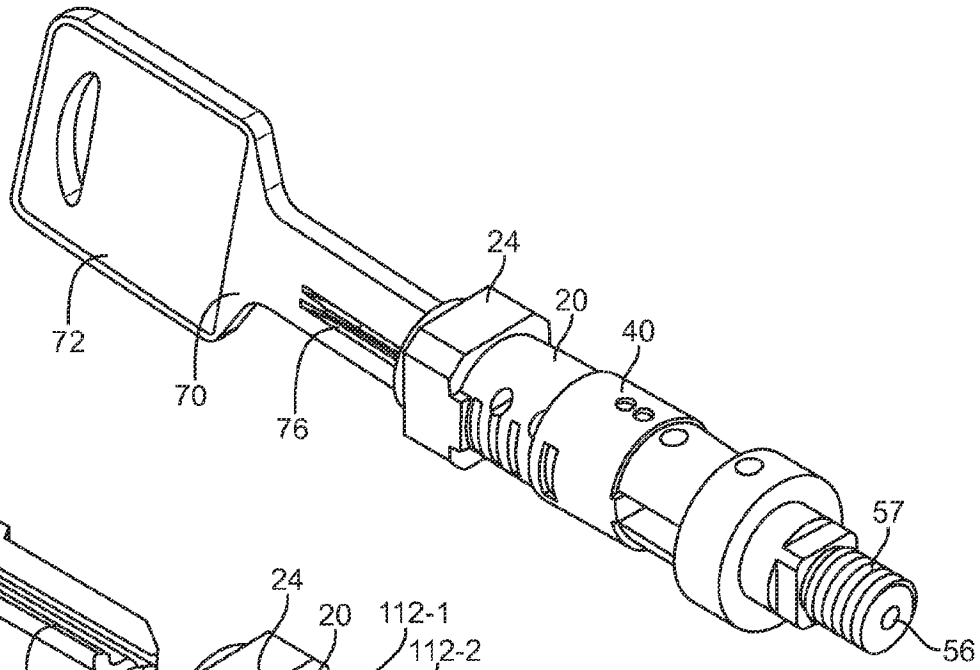
FIG. 27B is a perspective view of the reprogrammable cylinder lock as the second key is inserted to operate the reprogrammable lock.
Figure 27A:
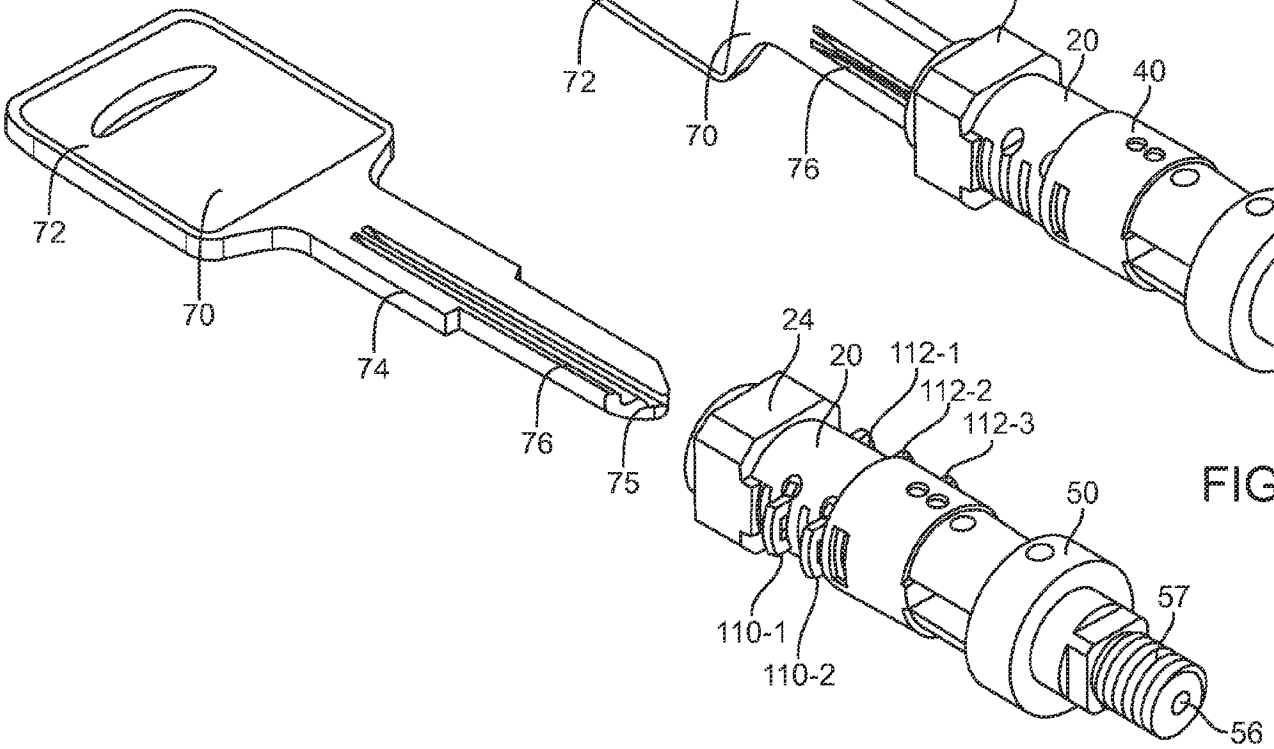
FIG. 27A is a perspective view of the reprogrammable cylinder lock prior to inserting a second key to operate the reprogrammable lock.

In another aspect, the second key 70 may reprogram the lock 10 to create a second code combination B shown in FIGS. 27A-26B, such as in the event that the first key 60 is lost. As the second key 70 is inserted into the lock 10 through the keyway 21, the second blade 74 slides through the first right pin lock opening 105-1, the first left pin lock opening 115-1, the second right pin lock opening 105-2 and the second left pin lock opening 115-2. Since the second blade 74 is longer than the first blade 64, the second tip 75 touches the cylinder ring bar 51 at the center notch 52 and further pushes the cylinder ring 40 back to a second position. As the cylinder ring 40 moves into the second position, the metal ball 130 aligns with the first metal ball notch 79, the metal ball spring 140 decompresses and pushes the metal ball up into the first metal ball notch 79, and the metal ball 130 is securely held in the first metal ball notch 79. Concurrently, a third left pin lock 112-3 is activated and released through the right pin lock slit 54, the second blade 74 slides further through a third left pin lock opening 115-3, and the third left pin lock 112-3 is biased against the right internal groove 42 such that the cylinder core 20 is initially nonrotatable.

The second set of cuts 76 then engages with the first right pin lock ridge 106-1, the first left pin lock ridge 116-1, the second right pin lock ridge 106-2, the second left pin lock ridge 116-2, and a third left pin lock ridge 116-3. Upon applying torque to the second bow 72 and rotating the cylinder core 20 at 90°, the first left pin lock 112-1, the first right pin lock 110-1, the second left pin lock 112-2, the second right pin lock 110-2 and the third left pin lock 112-3 are forced to be displaced from the right internal groove 42 and the left internal groove 43. The first right spring 120-1 attached to the first right pin lock 110-1 and the second right spring 120-2 attached to the second right pin lock 110-2 are compressed into the first right spring slot 27-1, and the second right spring slot 27-2, respectively. Similarly, the first left spring 122-1 attached to the first left pin lock 112-1, the second left spring 122-2 attached to the second left pin lock 112-2 and the third left spring 122-3 attached to the third left pin lock 112-3 are forced to be compressed into the first left spring slot 23-1, the second left spring slot 23-2, and the third left spring slot 23-3 respectively. As a result, the first right pin lock 110-1 retracts into the first right pin lock slot 25-1, the second right pin lock 110-2 retracts into the second right pin lock slot 25-2, the first left pin lock 112-1 retracts into the first left pin lock slot 22-1, the second left pin lock 112-2 retracts into the second left pin lock slot 22-2, and the third left pin lock 112-3 retracts into the third left pin lock slot 22-3. In this configuration, the cylinder core 20 becomes rotatable within the cylinder housing 30 to unlock the door handle or the latch using the second key 70.

It shall be appreciated that since the first key 60 only engages the first two right pin locks 110-1 and 110-2 and the first two left pin locks 112-1 and 112-2, once the cylinder ring 40 is in the second position B, the first key 60 can no longer be used.

Figures 28A, 28B:
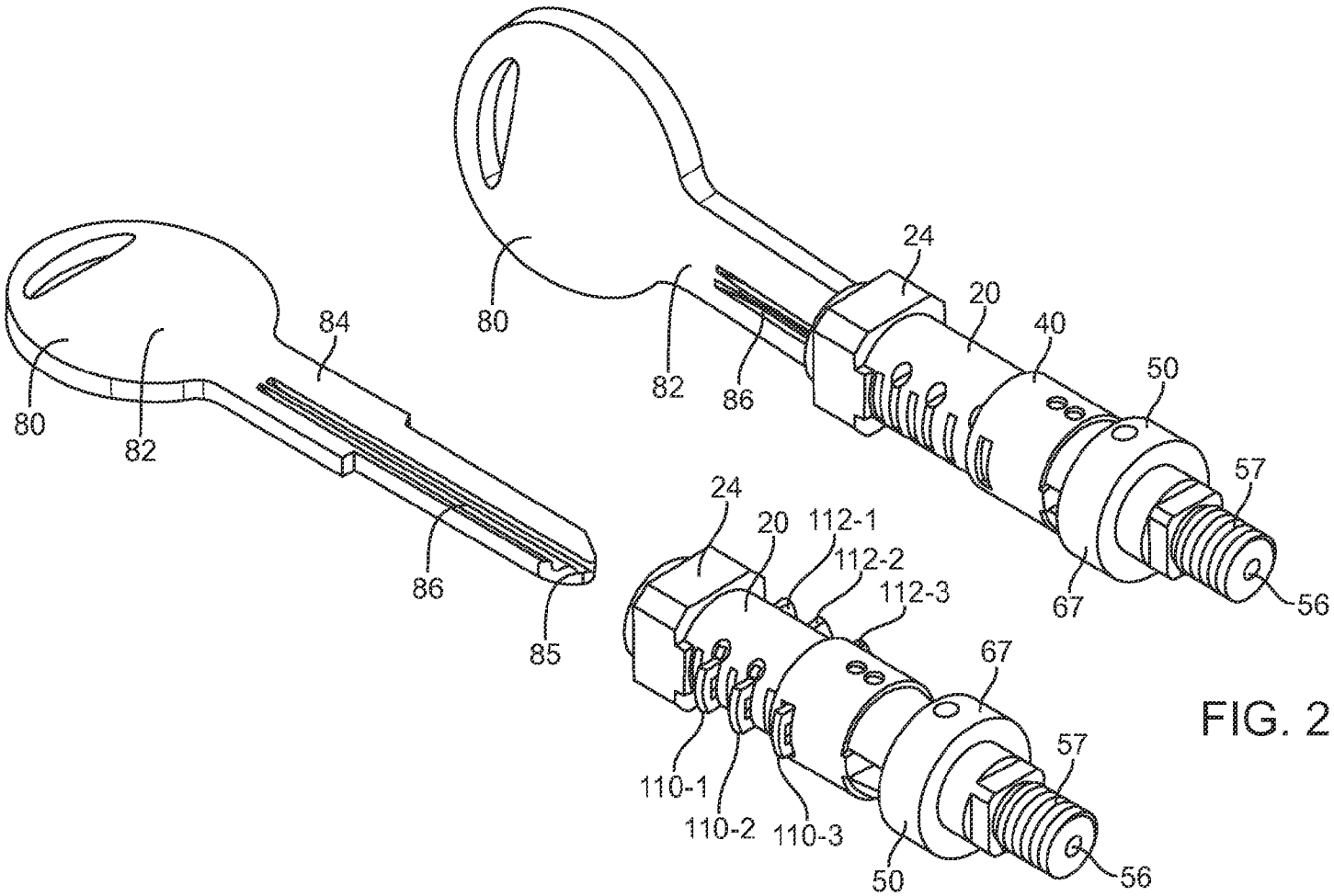
FIG. 28A is a perspective view of the reprogrammable cylinder lock prior to inserting a third key to operate the reprogrammable lock.
FIG. 28B is a perspective view of the reprogrammable cylinder lock as the third key is inserted to operate the reprogrammable lock.

According to yet another aspect, the third key 80 may reprogram the lock 10 to create yet a third code combination C shown in FIGS. 28A-28B, such as in the event that the first key 60 and the second key 70 are lost. As the third key 80 is inserted into the lock 10 through the keyway 21, the third blade 84 slides through the first right pin lock opening 105-1, the first left pin lock opening 115-1, the second right pin lock opening 105-2, the second left pin lock opening 115-2, and the third left pin lock opening 115-3. Since the second blade 84 is longer than the first blade 64 and the second blade 74, the third tip 85 touches the cylinder ring bar 51 at the center notch 52 and further pushes the cylinder ring 40 back to a third position. As the cylinder ring 40 moves into the third position, the metal ball 130 aligns with the second metal ball notch 36, the metal ball spring 140 decompresses and pushes the metal ball into the second metal ball notch 36, and the metal ball 130 is securely held in the third metal ball notch 36. Concurrently, a third right pin lock 110-3 is activated and released through the left pin lock slit 53, the third blade 84 slides further through a third left pin lock opening 105-3, and the third right pin lock 110-3 is biased against the left internal groove 43 such that the cylinder core 20 is initially nonrotatable.

The third set of cuts 86 then engages with the first right pin lock ridge 106-1, the first left pin lock ridge 116-1, the second right pin lock ridge 106-2, the second left pin lock ridge 116-2, the third right pin lock ridge 106-3, and a third left pin lock ridge 116-3. Upon applying torque to the third bow 82 and rotating the cylinder core 20, preferably at 90°, the first left pin lock 112-1, the first right pin lock 110-1, the second left pin lock 112-2, the second right pin lock 110-2, the third left pin lock 112-3, and the third right pin lock 110-3 are forced to be displaced from the right internal groove 42 and the left internal groove 43. The first right spring 120-1 attached to the first right pin lock 110-1, the second right spring 120-2 attached to the second right pin lock 110-2, and the third right spring 120-3 attached to the third right pin lock 110-3 are compressed into the first right spring slot 27-1, the second right spring slot 27-2 and the third right spring slot 27-3, respectively. Similarly, the first left spring 122-1 attached to the first left pin lock 112-1, the second left spring 122-2 attached to the second left pin lock 112-2 and a third left spring 122-3 attached to the third left pin lock 112-3 are forced to be compressed into the first left spring slot 23-1, the second left spring slot 23-2 and a third left spring slot 23-3, respectively. As a result, the first right pin lock 110-1 retracts into the first right pin lock slot 25-1, the second right pin lock 110-2 retracts into the second right pin lock slot 25-2, the third right pin lock 110-3 retracts into the third right pin lock slot 25-3, the first left pin lock 112-1 retracts into the first left pin lock slot 22-1, the second left pin lock 112-2 retracts into the second left pin lock slot 22-2, and the third left pin lock 112-3 retracts into a third left pin lock slot 22-3. In this configuration, the cylinder core 20 becomes rotatable within the cylinder housing 30 to unlock the door handle or the latch using the third key 80.

It shall be appreciated that the first key 60 only engages the first two right pin locks 110-1 and 110-2 and the first two left pin locks 112-1 and 112-2; and the second key 70 only engages the first two right pin locks 110-1 and 110-2 and the first three left pin locks 112-1, 112-2 and 112-3. Accordingly, when the cylinder ring 40 is in the third position C, the first key 60 and the second key 70 can no longer be used.

Figure 29B:
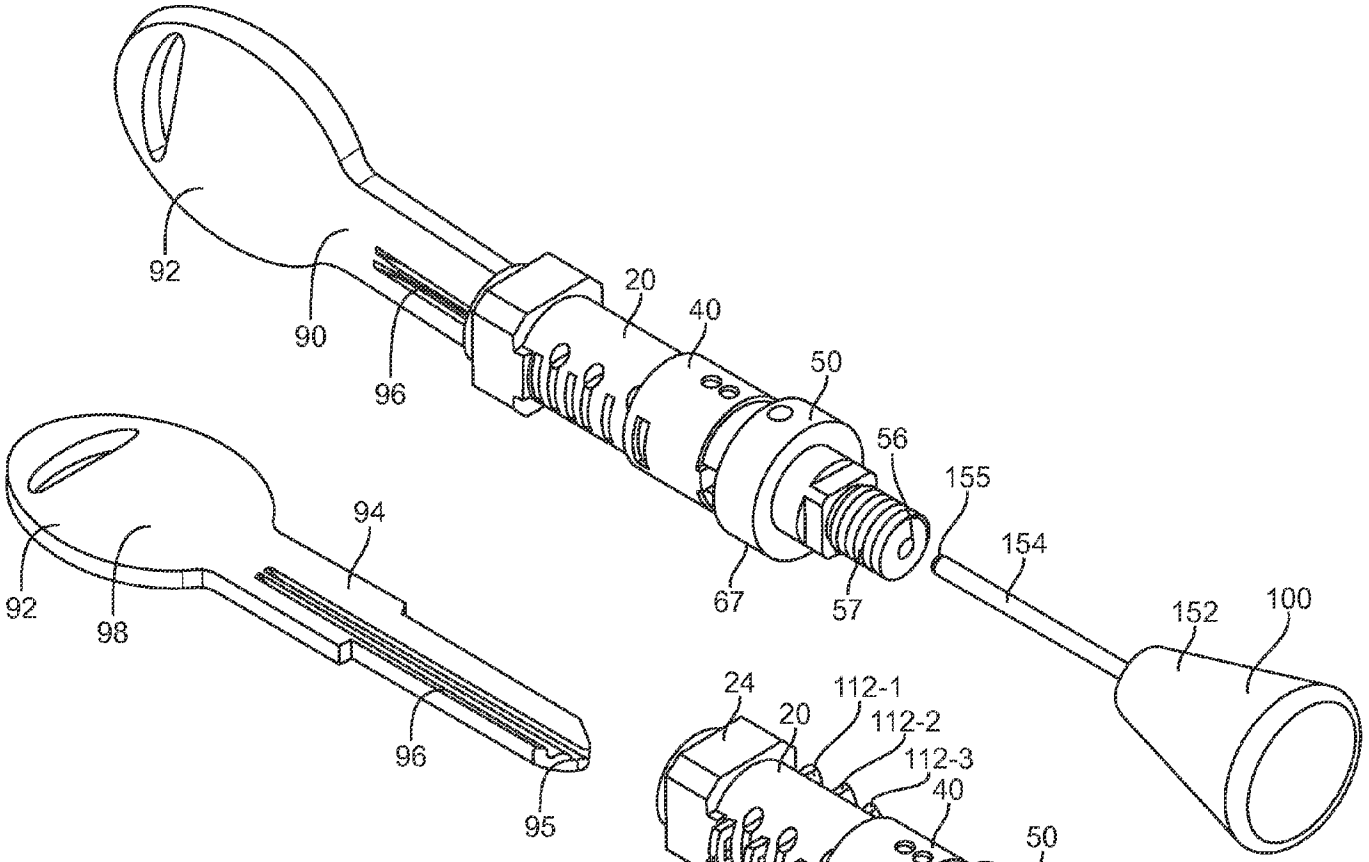
FIG. 29B is a perspective view of the reprogrammable cylinder lock as the fourth key is inserted to operate the reprogrammable lock.
Figure 29A:
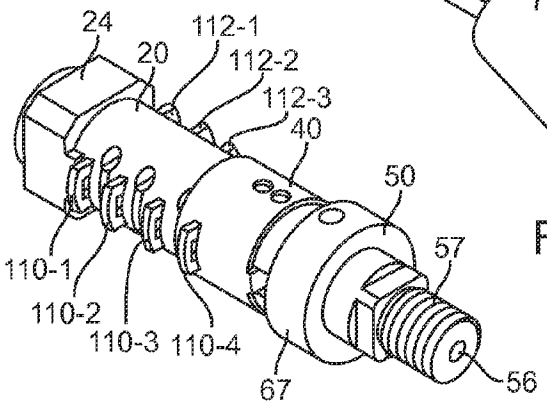
FIG. 29A is a perspective view of the reprogrammable cylinder lock prior to inserting a fourth key to operate the reprogrammable lock.

In yet another aspect, the fourth key 90 may reprogram the lock 10 to create yet a fourth code combination D shown in FIGS. 29A-29B, such as in the event that the first key 60, the second key 70 and the third key 80 are lost. As the fourth key 90 is inserted into the lock 10 through the keyway 21, the fourth blade 94 slides through the first right pin lock opening 105-1, the first left pin lock opening 115-1, the second right pin lock opening 105-2, the second left pin lock opening 115-2, the third right pin lock opening 105-3 and the third left pin lock opening 115-3. Since the fourth blade 94 is longer than the first blade 64, the second blade 74 and the third blade 84, the tip 95 touches the cylinder bar 51 at the center notch 52 and further pushes the cylinder ring 40 back to a fourth position. In one preferred embodiment, as the cylinder ring 40 moves into the fourth position, the metal ball 130 aligns with a third metal ball notch 126, the metal ball spring 140 decompresses and pushes the metal ball into the third metal ball notch 126 (not shown), and the metal ball 130 is securely held in the third metal ball notch 126. Concurrently, a fourth left pin lock 112-4 is activated and released through the left pin lock slit 53, the fourth blade 94 slides further through a fourth left pin lock opening 115-4, and the fourth left pin lock 112-4 is biased against the internal groove 43 such that the cylinder core 20 is initially nonrotatable.

The fourth set of cuts 96 then engages with the first right pin lock ridge 106-1, the first left pin lock ridge 116-1, the second right pin lock ridge 106-2, the second left pin lock ridge 116-2, the third right pin lock ridge 106-3, the third left pin lock ridge 116-3, and a fourth left pin lock ridge 116-4. Upon applying torque to the fourth bow 92 and rotating the cylinder core 20, preferably at 90°, the first left pin lock 112-1, the first right pin lock 110-1, the second left pin lock 112-2, the second right pin lock 110-2, the third left pin lock 112-3, the third right pin lock 110-3 and the fourth left pin lock 112-4 are forced to be displaced from the right internal groove 42 and the left internal groove 43. The first right spring 120-1 attached to the first right pin lock 110-1, the second right spring 120-2 attached to the second right pin lock 110-2, and the third right spring 120-3 attached to the third right pin lock 110-3 are compressed into the first right spring slot 27-1, the second right spring slot 27-2 and the third right spring slot 27-3, respectively. Similarly, the first left spring 122-1 attached to the first left pin lock 112-1, the second left spring 122-2 attached to the second left pin lock 112-2, the third left spring 122-3 attached to the third left pin lock 112-3 and a fourth left spring 122-4 attached to the fourth left pin lock 112-4 are forced to be compressed into the first left spring slot 23-1, the second left spring slot 23-2, the third left spring slot 23-3 and a fourth left spring slot 23-4, respectively. As a result, the first right pin lock 110-1 retracts into the first right pin lock slot 25-1, the second right pin lock 110-2 retracts into the second right pin lock slot 25-2, the third right pin lock 110-3 retracts into the third right pin lock slot 25-3, the first left pin lock 112-1 retracts into the first left pin lock slot 22-1, the second left pin lock 112-2 retracts into the second left pin lock slot 22-2, the third left pin lock 112-3 retracts into the third left pin lock slot 22-3, and the fourth left pin lock 112-4 retracts into a fourth left pin lock slot 22-4. In this configuration, the cylinder core 20 becomes rotatable within the cylinder housing 30 to unlock the door handle or the latch using the fourth key 90.

It shall be appreciated that the first key 60 only engages the first two right pin locks 110-1 and 110-2 and the first two left pin locks 112-1 and 112-2; the second key 70 only engages the first two right pin locks 110-1 and 110-2 and the first three left pin locks 112-1, 112-2 and 112-3; and the third key 80 only engages the first three right pin locks 110-1, 110-2 and 110-3 and the first three left pin locks 112-1, 112-2 and 112-3. Accordingly, when the cylinder ring 40 is in the fourth position D, the first key 60, the second key 70 and the third key 80 can no longer be used.

According to the preferred embodiment, the code combinations can be reset to the initial code combination A, such that the first key 60 can be reused again, by inserting the reset key pin blade 154 into the reset key channel 56 in the back and pushing the cylinder ring bar 51 forward to the first code combination A.

Figure 30:
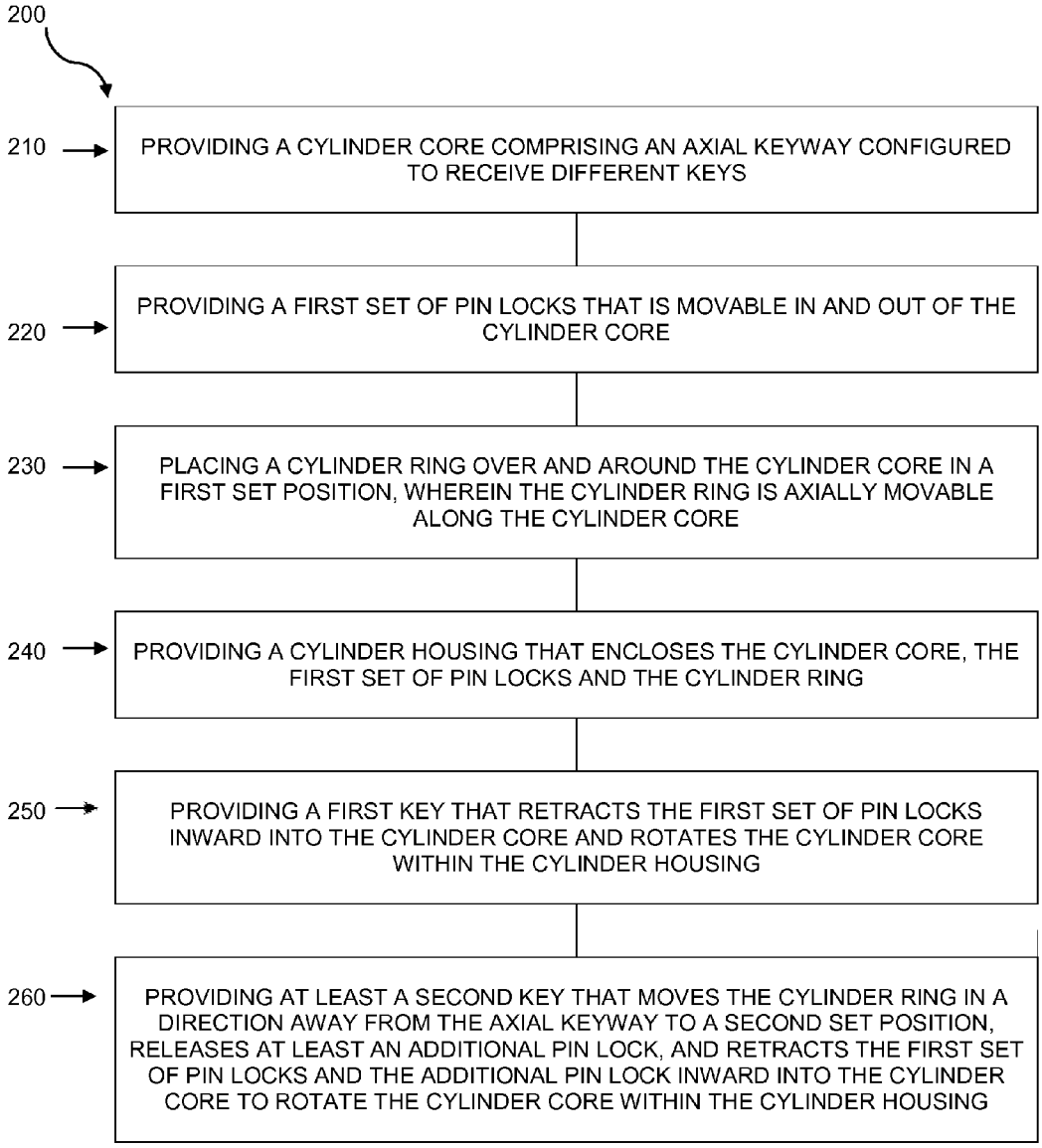
FIG. 30 is a diagram of a preferred method of providing a reprogrammable cylinder lock.

FIG. 30 illustrates a preferred method 200 of providing a reprogrammable cylinder lock. The method 200 may comprise a step 210 of providing a cylinder core comprising an axial keyway configured to receive different keys, a step 220 of providing a first set of pin locks that is movable in and out of the cylinder core, a step 230 of placing a cylinder ring over and around the cylinder core in a first set position, wherein the cylinder ring is axially movable along the cylinder core, a step 240 of providing a cylinder housing that encloses the cylinder core, the first set of pin locks and the cylinder ring, a step 250 of providing a first key that retracts the first set of pin locks inward into the cylinder core and rotates the cylinder core within the cylinder housing, and a step 260 of providing at least a second key that moves the cylinder ring in a direction away from the axial keyway to a second set position, releases at least an additional pin lock, and retracts the first set of pin locks and the additional pin lock inward into the cylinder core to rotate the cylinder core within the cylinder housing. Further, the method 200 may further comprise a step 270 of providing a head bolt attached to a door latch, wherein the head bolt further comprises an opening configured to receive a reset key.

The step 210 of providing a cylinder core comprising an axial keyway configured to receive different keys may further comprise providing a plurality of pin lock slots and a plurality of spring slots in the cylinder core. In one aspect, the step 210 may further comprise providing a plurality of right pin lock slots attached to a plurality of right spring slots and a plurality of left pin lock slots attached to the plurality of left spring slots. Further, a channel to allow a cylinder ring to axially move along the cylinder core may also be provided.

The step 220 of providing a first set of pin locks that is movable in and out of the cylinder core may further comprise providing plurality of right pin locks and a plurality of left pin locks. Further the step 220 may further comprise providing a plurality of right springs attached to the plurality of right pin locks and a plurality of left springs attached to the plurality of left pin locks.

In the preferred method, each of the pin lock may comprise a curved right edge, a top edge, a curved left edge, a bottom edge, a center keyway opening, a ridge and a spring tip. Further, the spring tip may further comprise an angular side and a vertical side, wherein the vertical side rests against a spring.

The step 230 of placing a cylinder ring over and around the cylinder core in a first set position, wherein the cylinder ring is axially movable along the cylinder core may further comprise providing a cylinder ring having a bar across its diameter. In the method that provides a channel in the cylinder core, the cylinder ring bar may be placed in the channel such that the cylinder ring may axially move along the cylinder core.

The step 240 of providing a cylinder housing that encloses the cylinder core, the first set of pin locks and the cylinder ring may further comprise providing the cylinder housing having a front chamber, a back chamber and at least an internal groove that matches the shape of the pin locks. In a default position, the plurality of pin locks is flush against the internal groove of the cylinder housing.

The step 250 of providing a first key that retracts the first set of pin locks inward into the cylinder core and rotates the cylinder core within the cylinder housing may further comprise providing the first key having a first blade and a first set of cuts that engage with the first set of pin locks to create a first combination to operate the reprogrammable lock.

The step 260 of providing at least a second key that moves the cylinder ring in a direction away from the axial keyway to a second set position, releases at least an additional pin lock, and retracts the first set of pin locks and the additional pin lock inward into the cylinder core to rotate the cylinder core within the cylinder housing. The step 260 may further comprise providing the second key having a second blade that is longer than the first blade of the first key and a first set of cuts that engage with the first set of pin locks and the additional pin lock to create a second combination to operate the reprogrammable lock.

In another embodiment, the step 260 may further comprise providing a third key that moves the cylinder ring in a direction away from the axial keyway to a third set position, releases a second additional pin lock, and retracts the first set of pin locks, the first additional pin lock and the second additional pin lock inward into the cylinder core to rotate the cylinder core within the cylinder housing. In this embodiment, the step 260 may further comprise providing the third key having a third blade that is longer than the first blade of the first key and the second blade of the second key, and a third set of cuts that engage with the first set of pin locks, the first additional pin lock and the second additional pin lock to create a third combination to operate the reprogrammable lock.

In yet another embodiment, the step 260 may further comprise providing a fourth key that moves the cylinder ring in a direction away from the axial keyway to a fourth set position, releases a third additional pin lock, and retracts the first set of pin locks, the first additional pin lock, the second additional pin lock and the third additional pin lock inward into the cylinder core to rotate the cylinder core within the cylinder housing. In this embodiment, the step 260 may further comprise providing the fourth key having a fourth blade that is longer than the first blade of the first key, the second blade of the second key and the third blade of the third key, and a fourth set of cuts that engage with the first set of pin locks, the first additional pin lock, the second additional pin lock and the third additional pin lock to create a third combination to operate the reprogrammable lock.

The step 270 of providing a head bolt attached to a door latch, wherein the head bolt further comprises an opening configured to receive a reset key may further comprise providing a reset key having a pin blade that can be inserted through the opening in the head bolt to reset the cylinder ring to the first set position.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A reprogrammable cylinder lock comprising:

a cylinder core, further comprising an axial keyway and a plurality of side slots perpendicular to the axial keyway;

a plurality of pin locks movable within the plurality of side slots;

a cylinder ring placed over and around the cylinder core in a first set position, wherein the cylinder ring is axially movable along the cylinder core;

a cylinder housing enclosing the cylinder core, the plurality of pin locks and the cylinder ring, wherein the plurality of pin locks are biased outward and flush against an internal contour of the cylinder housing such that the cylinder core is initially nonrotatable; and at least a first key and a second key, wherein the first key further comprising a first tip, a first blade and a first cut and the second key further comprising a second tip, a second blade and a second cut, and the second blade is longer than the first blade, wherein upon inserting the first key into the axial keyway and rotating the first key, the first cut engages with the plurality of pin locks, the plurality of pin locks retracts inward within the plurality of side slots into the cylinder core to allow the cylinder core to rotate within the cylinder housing, and wherein upon removing the first key from the axial keyway and inserting the second key into the axial keyway and rotating the second key, the second cut engages with the plurality of pin locks, the second tip axially pushes the cylinder ring in a direction away from the axial keyway to a second set position such that the first key cannot be reused, and the plurality of pin locks retracts inward within the plurality of side slots into the cylinder core to allow the cylinder core to rotate within the cylinder housing.

2. The reprogrammable cylinder lock of claim 1, further comprising a third key having a third tip, a third blade and a third cut, wherein upon removing the second key from the axial keyway and inserting the third key into the axial keyway and rotating the third key, the third cut engages with the plurality of pin locks, the third tip axially pushes the cylinder ring in a direction away from the axial keyway to a third set position such that the first key and the second key cannot be reused, and the plurality of pin locks retracts inward within the plurality of side slots into the cylinder core to allow the cylinder core to rotate within the cylinder housing.

3. The reprogrammable cylinder lock of claim 2, further comprising a fourth key having a fourth tip, a fourth blade and a fourth cut, wherein upon removing the third key from the axial keyway and inserting the fourth key into the axial keyway and rotating the fourth key, the fourth cut engages with the plurality of pin locks, the fourth tip axially pushes the cylinder ring in a direction away from the axial keyway to a fourth set position such that the first key, the second key and the third key cannot be reused, and the plurality of pin locks retracts inward within the plurality of side slots into the cylinder core to allow the cylinder core to rotate within the cylinder housing.

4. The reprogrammable cylinder lock of claim 1, further comprising a head bolt having an opening and a reset key configured to fit in the opening, such that when the reset key is inserted into the opening, the cylinder ring is returned to the first set position and the first key can be reused.

5. The reprogrammable cylinder lock of claim 1, wherein the plurality of pin locks further comprise a plurality of left pin locks and a plurality of right pin locks.

6. The reprogrammable cylinder lock of claim 1, wherein the cylinder core further comprising a shallow notch containing a metal ball and a compressed spring, and the cylinder ring further comprising a hole that fits the metal ball on one circumferential surface of the cylinder ring.

7. A reprogrammable cylinder lock comprising:

a cylinder core, further comprising an axial keyway;

a first set of pin locks movable into the cylinder core;

a cylinder ring placed over and around the cylinder core in a first set position, wherein the cylinder ring is axially movable along the cylinder core;

a cylinder housing enclosing the cylinder core, the first set of pin locks and the cylinder ring, wherein the first set of pin locks are biased outward and flush against an internal contour of the cylinder housing such that the cylinder core is initially nonrotatable; and at least a first key and a second key, wherein the first key further comprising a first tip, a first blade and a first cut and the second key further comprising a second tip, a second blade and a second cut, and the second blade is longer than the first blade, wherein upon inserting the first key into the axial keyway and rotating the first key, the first set of pin locks retract inward into the cylinder core to allow the cylinder core to rotate within the cylinder housing, and wherein upon removing the first key from the axial keyway and inserting the second key into the axial keyway and rotating the second key, the second cut engages with the first set of pin locks, the second tip axially pushes the cylinder ring in a direction away from the axial keyway to a second set position such that a first additional pin lock is released, and the first set of pin locks and the first additional pin lock retract inward into the cylinder core to allow the cylinder core to rotate within the cylinder housing.

8. The reprogrammable cylinder lock of claim 7, further comprising a third key having a third tip, a third blade and a third cut, wherein upon removing the second key from the axial keyway and inserting the third key into the axial keyway and rotating the third key, the third cut engages with the first set of pin locks, the third tip axially pushes the cylinder ring in a direction away from the axial keyway to a third set position such that a second additional pin lock is released, and the first set of pin locks, the first additional pin lock, and the second additional pin lock retract inward into the cylinder core to allow the cylinder core to rotate within the cylinder housing.

9. The reprogrammable cylinder lock of claim 8, further comprising a fourth key having a fourth tip, a fourth blade and a fourth cut, wherein upon removing the third key from the axial keyway and inserting the fourth key into the axial keyway and rotating the fourth key, the fourth cut engages with the first set of pin locks, the fourth tip axially pushes the cylinder ring in a direction away from the axial keyway to a fourth set position such that a third additional pin lock is released, and the first set of pin locks, the first additional pin lock, the second additional pin lock, and the third additional pin lock retract inward into the cylinder core to allow the cylinder core to rotate within the cylinder housing.

10. The reprogrammable cylinder lock of claim 7, further comprising a head bolt having an opening and a reset key configured to fit in the opening, such that when the reset key is inserted into the opening, the cylinder ring is returned to the first set position.

11. The reprogrammable cylinder lock of claim 7, wherein the first set of pin locks further comprise a plurality of left pin locks and a plurality of right pin locks.

12. The reprogrammable cylinder lock of claim 7, wherein the cylinder core further comprising a shallow notch containing a metal ball and a compressed spring, and the cylinder ring further comprising a hole that fits the metal ball on one circumferential surface of the cylinder ring.

13. A method of providing a reprogrammable cylinder lock comprising:

providing a cylinder core, further comprising an axial keyway configured to receive different keys;

providing a first set of pin locks that is movable in and out of the cylinder core;

providing a cylinder ring over and around the cylinder core in a first set position, wherein the cylinder ring is axially movable along the cylinder core;

providing a cylinder housing that encloses the cylinder core, the first set of pin locks and the cylinder ring, wherein the first set of pin locks are biased outward and flush against an internal contour of the cylinder housing such that the cylinder core is initially nonrotatable;

providing a first key that retracts the first set of pin locks inward into the cylinder core and rotates the cylinder core within the cylinder housing, and providing at least a second key that moves the cylinder ring in a direction away from the axial keyway to a second set position, releases at least an additional pin lock, and retracts the first set of pin locks and the additional pin lock inward into the cylinder core to rotate the cylinder core within the cylinder housing.

14. The method of providing a reprogrammable cylinder lock of claim 13, further comprising providing a third key that moves the cylinder ring in a direction away from the axial keyway to a third set position, releases a second additional pin lock, and retracts the first set of pin locks, the first additional pin lock, and the second additional pin lock to rotate the cylinder core within the cylinder housing.

15. A method of providing a reprogrammable cylinder lock of claim 14, further comprising providing a fourth key that moves the cylinder ring in a direction away from the axial keyway to a fourth set position, releases a third additional pin lock, and retracts the first set of pin locks, the first additional pin lock, the second additional pin lock, and the third additional pin lock into the cylinder core to rotate the cylinder core within the cylinder housing.

16. The method of providing a reprogrammable cylinder lock of claim 13, further comprising providing a head bolt having an opening and a reset key configured to fit in the opening, such that when the reset key is inserted into the opening, the cylinder ring is returned to the first set position.

17. The method of providing a reprogrammable cylinder lock of claim 13, wherein the step of providing a first set of pin locks further comprising providing a plurality of right pin locks and a plurality of left pin locks.

18. The method of providing a reprogrammable cylinder lock of claim 13, further comprising providing a shallow notch containing a metal ball and a compressed spring to the cylinder core, and providing a hole that fits the metal ball on one circumferential surface of the cylinder ring.

19. The method of providing a reprogrammable cylinder lock of claim 13, wherein the step of providing at least a second key that moves the cylinder ring in a direction away from the axial keyway to a second set position, releases a first additional pin lock, and retracts the first set of pin locks and the first additional pin lock inward into the cylinder core to rotate the cylinder core within the cylinder housing further comprising providing the second key that is longer than the first key.

20. The method of providing a reprogrammable cylinder lock of claim 15, wherein the third key and the fourth key are longer than the first key and the second key.

* * * * *